US007855334B2

(12) United States Patent
Yamashita et al.

(10) Patent No.: US 7,855,334 B2
(45) Date of Patent: Dec. 21, 2010

(54) MUSIC EDIT DEVICE AND MUSIC EDIT METHOD

(75) Inventors: Kosei Yamashita, Kanagawa (JP); Yasushi Miyajima, Kanagawa (JP); Motoyuki Takai, Tokyo (JP); Akihiro Komori, Tokyo (JP)

(73) Assignee: Sony Corporation, Tokyo (JP)

( * ) Notice: Subject to any disclaimer, the term of this patent is extended or adjusted under 35 U.S.C. 154(b) by 250 days.

(21) Appl. No.: 12/095,745

(22) PCT Filed: Dec. 7, 2006

(86) PCT No.: PCT/JP2006/324889

§ 371 (c)(1),
(2), (4) Date: Jun. 2, 2008

(87) PCT Pub. No.: WO2007/066818

PCT Pub. Date: Jun. 14, 2007

(65) Prior Publication Data

US 2009/0272253 A1 Nov. 5, 2009

(30) Foreign Application Priority Data

Dec. 9, 2005 (JP) ..... 2005-356830

(51) Int. Cl.
*G10H 1/00* (2006.01)

(52) U.S. Cl. ..... 84/612; 84/625; 84/652; 84/660

(58) Field of Classification Search ..... 84/600–602, 84/612, 636, 652, 668, 625, 660
See application file for complete search history.

(56) References Cited

U.S. PATENT DOCUMENTS 4,669,024 A * 5/1987 Stacey ..... 361/85

(Continued)

FOREIGN PATENT DOCUMENTS

JP 58 163998 9/1983

(Continued)

OTHER PUBLICATIONS

U.S. Appl. No. 12/093,059, filed May 8, 2008, Komori, et al.
U.S. Appl. No. 12/092,641, filed May 5, 2008, Miyajima, et al.

*Primary Examiner*—David S. Warren
(74) *Attorney, Agent, or Firm*—Oblon, Spivak, McClelland, Maier & Neustadt, L.L.P.

(57) ABSTRACT

A music editing apparatus is provided that uses so-called time line meta data that describe a beat and melody structure of a song to automatically accomplishes an automatic DJ remix play with a low load. The apparatus also includes a synchronous reproduction controlling section which sends a master beat to the remix processing section and reproduces a plurality of songs corresponding to a remix process which the remix processing section designates corresponding to a remix pattern and the meta data and a mixing section which mixes the songs reproduced by the synchronous reproduction controlling section. The synchronous reproduction controlling section also includes a phase comparator which compares a phase of a beat synchronous signal generated from the meta data supplied from the remix processing section with that of the master beat signal; an integrating circuit which integrates a phase compared output of the phase comparator; and a correcting section which corrects a tempo based on an integrated output of the integrating circuit.

11 Claims, 33 Drawing Sheets

U.S. PATENT DOCUMENTS

| | | | | |
|---|---|---|---|---|
| 4,862,485 | A * | 8/1989 | Guinea et al. | 375/376 |
| 5,015,939 | A * | 5/1991 | Konecny | 318/701 |
| 5,148,113 | A * | 9/1992 | Wight et al. | 327/3 |
| 5,684,844 | A * | 11/1997 | Bouzidi et al. | 375/376 |
| 7,189,913 | B2 * | 3/2007 | Moulios et al. | 84/612 |
| 7,208,672 | B2 * | 4/2007 | Camiel | 84/625 |
| 7,366,744 | B2 * | 4/2008 | Tomita | 1/1 |
| 7,592,534 | B2 * | 9/2009 | Yoshikawa et al. | 84/612 |
| 2003/0065517 | A1 * | 4/2003 | Miyashita et al. | 704/278 |
| 2003/0205124 | A1 * | 11/2003 | Foote et al. | 84/608 |
| 2004/0159221 | A1 * | 8/2004 | Camiel | 84/660 |
| 2004/0254660 | A1 * | 12/2004 | Seefeldt | 700/94 |
| 2005/0211072 | A1 * | 9/2005 | Lu et al. | 84/612 |
| 2006/0048634 | A1 * | 3/2006 | Lu et al. | 84/612 |
| 2006/0107822 | A1 * | 5/2006 | Bowen | 84/612 |
| 2007/0074618 | A1 * | 4/2007 | Vergo | 84/612 |
| 2008/0097633 | A1 * | 4/2008 | Jochelson et al. | 700/94 |
| 2008/0181292 | A1 * | 7/2008 | Yang et al. | 375/232 |
| 2008/0211588 | A1 * | 9/2008 | Frey et al. | 331/17 |
| 2009/0139389 | A1 * | 6/2009 | Bowen | 84/636 |
| 2009/0178542 | A1 * | 7/2009 | Jochelson et al. | 84/609 |
| 2009/0272253 | A1 * | 11/2009 | Yamashita et al. | 84/611 |

FOREIGN PATENT DOCUMENTS

| | | |
|---|---|---|
| JP | 6 342282 | 12/1994 |
| JP | 7 295589 | 11/1995 |
| JP | 2000 56780 | 2/2000 |
| JP | 3066528 | 5/2000 |
| JP | 2000 267655 | 9/2000 |
| JP | 2001 109470 | 4/2001 |
| JP | 2002 116754 | 4/2002 |
| JP | 2003 44046 | 2/2003 |
| JP | 2003 50588 | 2/2003 |
| JP | 2003 108132 | 4/2003 |
| JP | 2003 263162 | 9/2003 |
| JP | 2004 198759 | 7/2004 |
| JP | 2004 233965 | 8/2004 |
| JP | 2004 528596 | 9/2004 |

* cited by examiner

1
SYNCHRONOUSLY REPRODUCING SECTION
8
AUDIO OUTPUT SECTION
12
D/A
11
AUDIO MIXING SECTION
10
SYNCHRONOUS REPRODUCTION CONTROLLING SECTION
9
USER OPERATION I/F SECTION
15
U/I DISPLAY SECTION
16
STORAGE SECTION
4
SONG STORAGE SECTION
5
SONG META DATA STORAGE SECTION
6
REMIX PATTERN STORAGE SECTION
7
RAM
14
ROM
13
3
CPU
2

Fig. 5

30

| 31 BAR/BEAT | 32 ATTRIBUTE | 33 SAMPLE POSITION |
|---|---|---|
| 11 | 01800001 | 23190 |
| 12 | 01000001 | 65280 |
| 13 | 01000001 | 83200 |
| 14 | 01000001 | 100416 |
| 21 | 01800001 | 118400 |
| 22 | 01000001 | 136192 |

Fig. 9

60

| 61 SONG ID (FILE) | 62 REPRODUCTION PORTION | 63 EFFECT UPON REPRODUCTION | 64 CONNECTION PATTERN | 65 EFFECT UPON CONNECTION | 66 CONNECTION SE |
|---|---|---|---|---|---|
| ID_A | CATCHY PART | NONE | CROSS-FADE | REVERB | NONE |
| ID_B | INTRODUCTION | LOW-CUT | CUT-IN | LOW-CUT | NONE |
| ID_C | BAR 8 — 20 | NONE | CROSS-FADE | DISTORTION | SE_A |
| ID_D | ALL | HIGH-CUT | SIMULTANEOUS REPRODUCTION: CATCHY PART | NONE | NONE |
| ID_E | CATCHY PART | LOW-CUT | NONE | NONE | NONE |

Fig. 23A TIME WAVEFORM

Fig. 23B (SPECTROGRAM) → (BEATS) → CREATE TIME LINE META DATA

MUSIC EDIT DEVICE AND MUSIC EDIT METHOD

TECHNICAL FIELD

The present invention relates to a music editing apparatus and method of editing as materials music content or the like obtained from song parts, bars, and so forth into which songs are divided and creates new songs (music content).

BACKGROUND ART

As memory type audios have become common, users daily carry a large number of songs with them. With memory type audios that allow their users to listen to a large number of songs continuously without need to change mediums, a style in which the users not only successively listen to songs of each CD album, but listen to songs shuffled in all CD albums and their favorite songs arranged as play lists has become common. It can be said that the degree of freedom of which the users listen to their favorite songs in their favorite orders not in the orders of songs recorded in albums has increased.

However, it is assumed that the users listen to each song from the beginning to the end. In addition, there is a non-sound region between songs. In other words, one song is the minimum unit. Thus the user has to listen to music on the basis of one song. The user's concentration, namely his or her enthusiasm, breaks at such a non-sound region between songs. As a result, the users are difficult to continuously listen to songs with his or her tension kept.

FIG. 32 shows conventional music reproduction using song A and song B. In this case, the two songs are reproduced with their original tempos. Of course, there is a non-sound region between these songs.

Thus a technique of combining a plurality of music materials and editing them was developed. Japanese Patent Application Laid-Open No. 2003-44046 discloses a technique of combining a plurality of music materials that are input through a user's keyboard and mouse and allowing him or her to interactively edit them and to enjoy the reproduced songs. In the technology, sound pieces such as sound patterns and one-shots and tips composed of effects applicable to sound pieces are assigned to individual keys of the keyboard. When the user presses the keys, tips corresponding thereto are combined and output. When a plurality of keys are pressed at the same time, corresponding tips are combined and output. In addition, when keys are successively pressed, corresponding tips are chronologically combined and thereby a song is composed.

However, with the foregoing technique disclosed as Japanese Patent Application Laid-Open No. 2003-44046,it was difficult to recompose a song by connecting parts of a plurality of songs in such a manner that their beats are matched like with a remix created, for example, by a disc jockey (DJ). A DJ is currently a common occupation. There are label companies that dedicatedly deal with remix music. The number of users who enjoy remix music is increasing.

Taking into account of the rhythm of music in a music editing apparatus, it is preferred that while the rhythm of a song currently being reproduced is being followed in real time, a plurality of songs be reproduced successively or simultaneously in such a manner that the rhythm of each song is properly matched like does a professional DJ.

Persons having an occupation called DJs can successively connect a plurality of songs and reproduce them as if they were a series of songs with a record turn table by controlling the reproduction start timings and tempos of these songs. This technique is generally called a remix. Such rhythm synchronizing reproduction provides the listener with new sensation and excitement as an advanced music listening style one step beyond from the conventional simple listening manner. Thus, in recent years, the technique DJ remix has become common as a new music expression technique.

However, currently, it is very difficult to mechanically automate the DJ reproducing technique. This is because although senses of rhythm, beats, and tempo of music are amounts of senses that humans can easily perceive, machines are very difficult to recognize them. Even if an automatic recognition technology is used, its recognition accuracy does not become 100%. Thus machines are insufficient to be practically used for music arrangement that necessitates perfection. Since machines cannot understand the structure of music, they cannot automatically perform flexible arrangement reproduction based on a music structure like DJ play.

From the foregoing point of view, the present invention solves the following problems. DJs can seamlessly start reproducing the next song such that its beats and bars are matched with those of the song that is being reproduced. In contrast, since machines cannot recognize beats and bars, they cannot automatically perform such a process.

DJs can seamlessly start reproducing the next song such that its beats and bars are matched with those of the song that is being reproduced. In contrast, since machines cannot recognize beats and bars, they cannot automatically perform such a process.

DJs can seamlessly start reproducing the next song such that it's tempo is matched with that of the current song that it is currently reproducing even if the tempo of the current song changes. In contrast, since the machines cannot recognize the tempo, they cannot automatically perform such a process.

DJs can seamlessly start reproducing the next song such that its melody is matched with that of the song that is being reproduced. In contrast, since machines cannot recognize the rhythm, they cannot automatically perform such a process.

The present invention was created from the foregoing point of view. An object of the present invention is to provide a music editing apparatus that uses so-called time line meta data that describe a beat and melody structure of a song to automatically accomplish the automatic DJ remix play with a low load.

DISCLOSURE OF THE INVENTION

To solve the foregoing problem, a music editing apparatus of the present invention includes a remix processing section which performs a remix process based on both meta data pre-generated corresponding to song data and containing at least time-based beat positions and a remix pattern file; a synchronous reproduction controlling section which generates a master beat, sends the master beat to the remix processing section, and reproduces a plurality of songs with individual entries of the meta data corresponding to a remix process which the remix processing section designates corresponding to the remix pattern file and the meta data; and a mixing section which mixes the songs reproduced by the synchronous reproduction controlling section. The synchronous reproduction controlling section also includes a phase comparator which compares a phase of a beat synchronous signal generated from the meta data with that of the master beat signal; an integrating circuit which integrates a phase compared output of the phase comparator; and a correcting section which corrects a tempo based on an integrated output of the integrating circuit.

A music editing method of the present invention includes a remix processing step of performing a remix process based on both meta data pre-generated corresponding to song data and containing at least time-based beat positions and a remix pattern file; a synchronous reproduction controlling step of generating a master beat, sending the master beat to the remix processing section, and reproducing a plurality of songs corresponding to a remix process which the remix processing section designates corresponding to the remix pattern file and the meta data; and a mixing step of mixing the songs reproduced by the synchronous reproduction controlling section. The synchronous reproduction controlling step further includes a phase comparing step of comparing a phase of a beat synchronous signal generated from the meta data supplied from the remix processing step with that of the master beat signal; an integrating step of integrating a phase compared output of the phase comparator; and a correcting step of correcting a tempo based on an integrated output of the integrating step.

According to the present invention, when songs having different tempos and rhythms are reproduced as a remix, even if the beats of original music change, beat synchronous reproduction can be automatically performed in real time for the songs such that their tempos and rhythms are kept constant.

Thus, according to the present invention, since music can be automatically reproduced as the DJ remix play in real time, a music reproducing apparatus can provide a new music listening style. In addition, as an application of the present invention, since the beats of music can be easily synchronized with those of another medium, a new entertainment can be created.

BRIEF DESCRIPTION OF DRAWINGS

FIG. 5 is a schematic diagram showing time-based meta data;

FIG. 9 is a schematic diagram showing a specific example of a remix pattern file;

FIG. 13 is a schematic diagram for describing a connection with cut-in;

FIG. 23A, FIG. 23B, and FIG. 23C are schematic diagrams for describing a problem involved in changes of the tempo;

BEST MODES FOR CARRYING OUT THE INVENTION

Figure 1:
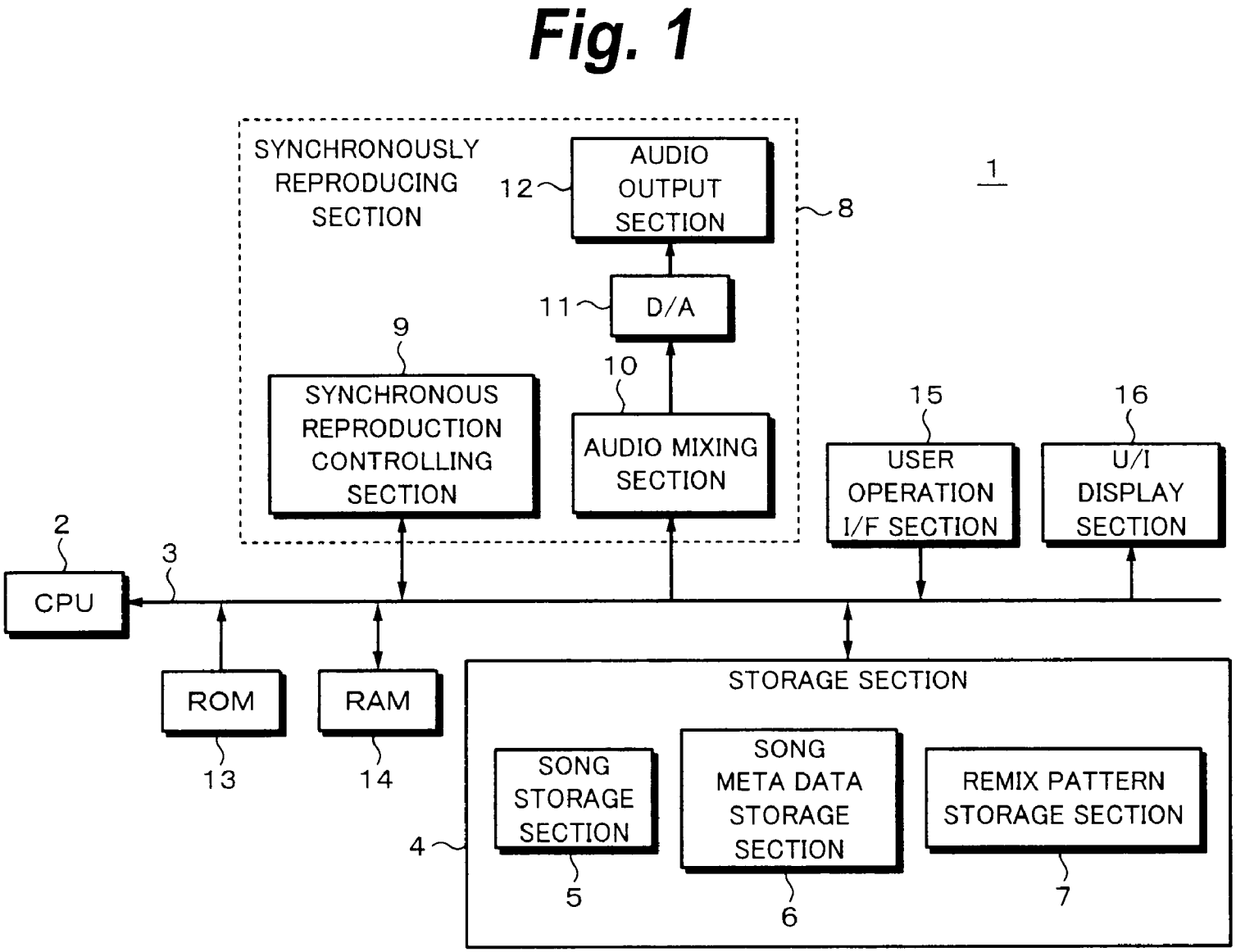
FIG. 1 is a block diagram showing a music editing apparatus 1 according to an embodiment of an apparatus and a method of the present invention.

Next, with reference to the accompanying drawings, best mode embodiments for carrying out the present invention will be described. FIG. 1 is a block diagram showing a music editing apparatus 1 according to an embodiment of an apparatus and method of the present invention.

The music editing apparatus 1 is an automatic DJ reproducing section that reproduce song A and song B having different tempos as music content data (original data) of songs provided through various types of record mediums such as a hard disk (HD), a compact disc (CD), a mini disc (MD), a digital versatile disc (DVD), and so forth and through networks such as the Internet with meta data described later in such a manner that their beats are matched or they are overlaid.

As shown in FIG. 1, in the music editing apparatus 1, a central processing unit (CPU) 2 is connected to a storage section 4 and a synchronously reproducing section 8 through a bus 3. In addition, connected to the CPU 2 through the bus 3 are a ROM 13, a RAM 14, a user operation I/F section 15, and a user interface (U/I) display section 16.

The CPU 2 decides a connecting method for songs in real time and supplies necessary song materials to the synchronously reproducing section 8 at a necessary timing. In addition, corresponding to a user's operation, the CPU 2 designates a tempo and beat synchronization/asynchronization for the synchronously reproducing section 8.

The storage section 4 is composed of a song storage section 5, a song meta data storage section 6, and a remix pattern storage section 7. The song storage section 5 is a storage section that stores data of a plurality of songs. A storage section such as a flash memory or a hard disk that a console type music reproducing apparatus or a portable music reproducing apparatus has may be connected as an external device. Song data that are stored in the song storage section 5 may be regardless of compressed music data or non-compressed data.

The song meta data storage section 6 is a storage section such as a flash memory or a hard disc and stores time-based meta data added to songs. As will be described later, meta data are time-based auxiliary data added to songs and describe position information of beats as well as tempos, position information of the beginnings of bars (simply referred to as beginnings), and melody information such as introductions and themes (catchy parts).

Like the song storage section 5, the remix pattern storage section 7 is not limited to a particular type as long as it is a storage device. The remix pattern storage section 7 is a storage section that stores a remix pattern file that designates a remix pattern designating method. As will be described later, a remix pattern file is not only a file that describes the order of songs, but a file that describes a song order plus a manner of combining song A and song B or a manner of what parts of song A and song B are used and where they are combined.

The synchronously reproducing section 8 is a signal processing block with which the music editing apparatus 1 automatically performs the DJ reproduction. The synchronously reproducing section 8 reproduces song materials designated by a remix control function of the CPU 2 in synchronization with a reference beat. The synchronously reproducing section 8 is composed of a synchronous reproduction controlling section 9, an audio mixing section 10, a digital/analog converting section (D/A) 11, and an audio output section 12.

The synchronous reproduction controlling section 9 has a plurality of audio signal generating sections and reproduces a plurality of audio signals in synchronization with a locally generated clock signal. In addition, the synchronous reproduction controlling section 9 always monitors the position of a song that is being currently reproduced on the basis of meta data supplied from the meta data storage section 6 and sends the current reproduction position (such as a reproduction position as a sample count in the song) and a reproduction position as a bar count and a beat count back to the remix process function section of the CPU 2.

The audio mixing section 10 mixes a plurality of audio signals generated by the plurality of audio signal generating sections of the synchronous reproduction controlling section 9 and outputs the mixed signal. The D/A 11 converts the digital signal reproduced by the audio mixing section 10 into an analog signal. The audio output section 12 amplifies the analog audio signal supplied from the D/A 11 and outputs the amplified signal to a speaker, a headphone, or the like.

The ROM 13 stores a music editing program composed of processes based on the music editing method according to the present invention. In addition, the ROM 13 stores various types of default data. The RAM 14 becomes a work area with which the CPU 2 executes the music editing program. In addition, the RAM 14 stores various types of update data with which the CPU 2 executes the music editing program.

The user operation I/F section 15 is, for example, a keyboard, a mouse, a touch panel, and/or the like that accepts user's operations. The U/I display section 16 is a display section including a touch panel that displays a current operation state and a music editing process state and accepts user's operations. The U/I display section 16 is, for example, a liquid crystal display device. Of coarse, the U/I display section 16 may be a CRT.

Figure 2:
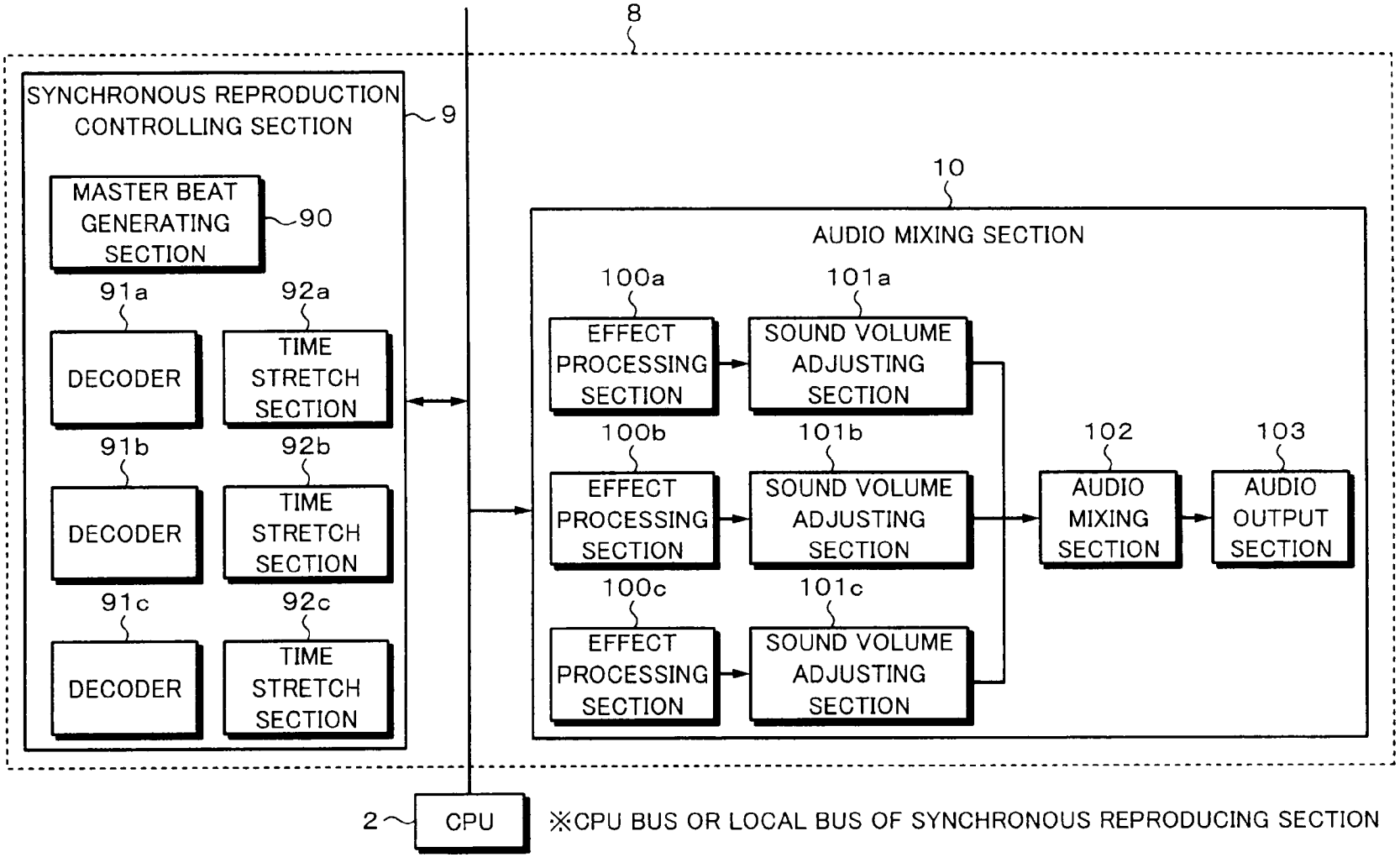
FIG. 2 is a block diagram showing detailed structures of a synchronous reproduction controlling section and an audio mixing section.

FIG. 2 is a block diagram showing detailed structures of the synchronous reproduction controlling section 9 and the audio mixing section 10. The synchronous reproduction controlling section 9 is composed of a master beat generating section 90 and three audio signal generating sections. The master beat generating section 90 generates a clock equivalent to a beat. Specifically, the master beat generating section 90 outputs a tempo of a remix and a beat signal in synchronization with the tempo. The master beat generating section 90 generates a bar beginning signal and a regular beat signal other than the bar beginning signal corresponding to a designated rhythm (in four-four rhythm, three-four rhythm, and so forth) and outputs them.

The three (tracks of) audio signal generating sections have three tracks to output a plurality of stereo sounds in real time, as a typical example, song A, song B, and sound effect (SE). Of course, the audio signal generating section may have four tracks, five tracks, or more corresponding to the number of songs. The audio signal generating section synchronously reproduces bar/beat positions of songs corresponding to the bar/beat positions of the master beat based on the synchronous signal (clock or beat) generated by the master beat generating section 90.

For individual tracks, decoders 91*a*, 91*b*, and 91*c* and time stretch sections 92*a*, 92*b*, and 92*c* are provided. The decoders 91*a*, 91*b*, and 91*c* decode compressed sounds that have been compressed according to MP3 or ATRAC and output decoded sounds as PCM data. In this case, since SE is short and its data size is small, it does not always need to have been compressed. Thus the decoder for the SE track may be omitted. The time stretch sections 92*a*, 92*b*, and 92*c* are sections that convert a reproduction speed while the intervals of songs are kept constant. The time stretch sections 92*a*, 92*b*, and 92*c* cause tempos of song materials to match the tempo of the reference beat based on meta data supplied from the song meta data storage section 6. The time stretch sections 92*a*, 92*b*, and 92*c* perform a process of changing the reproduction speed in real time based on the ratio of the original tempos of songs and the tempo of the master beat. Thus the original tempos of songs can be matched with the tempo of the master beat. Of course, as described above, the intervals of songs are not changed.

The audio signal generating sections may have a pitch shifter function. The pitch shifter function changes the interval of a song while the reproduction speed is kept constant. The pitch shifter function is used to musically harmonize song materials having different intervals and pitches. However, the pitch shifter function is not an essential function, but an additional function.

The audio mixing section 10 has three effect processing sections 100*a*, 100*b*, and 100*c* and three sound volume adjusting sections 101*a*, 101*b*, and 101*c* corresponding to the three tracks of audio signal generating sections. The outputs of these three systems are mixed by an audio mixing section 102, amplified by an audio output section 103, and then output to the external speaker, headphone, or the like. The audio mixing section 10 can perform an effect process and an sound volume adjustment process for the individual tracks of the output audio signals supplied from the audio signal generating sections.

Figure 3:
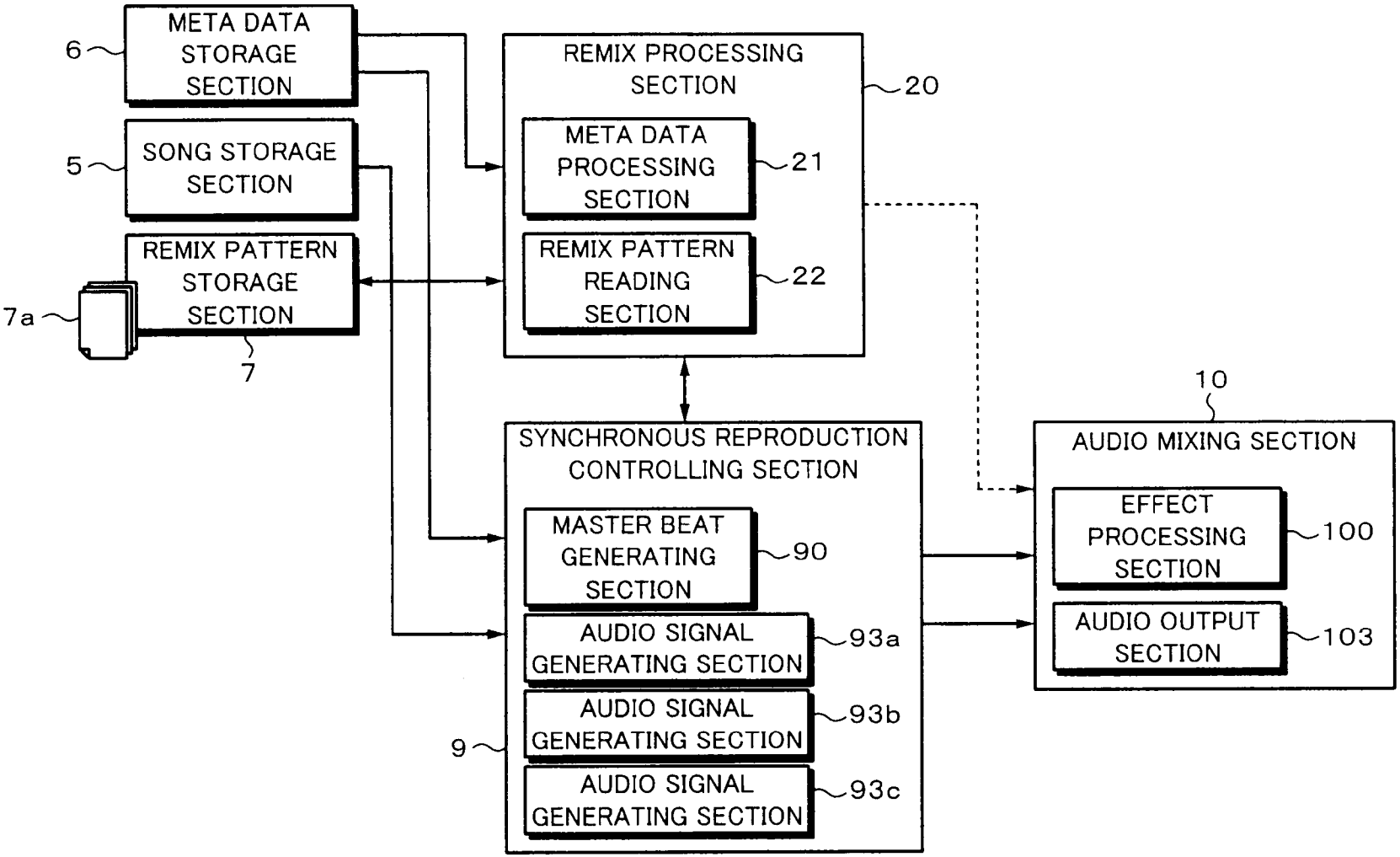
FIG. 3 is a functional block diagram showing the music editing apparatus.

FIG. 3 is a functional block diagram of the music editing apparatus 1. In FIG. 3, a function of the CPU 2 shown in FIG. 1 as a hardware structure is represented by a remix processing section 20. The remix processing section 20 is composed of a meta data processing section 21 and a remix pattern reading section 22.

In the remix processing section 20, the meta data processing section 21 processes meta data stored in the song meta data storage section 6. As described above, time-based meta data have been added to songs. Meta data contain not only information about a tempo, but position information of beats, bar beginning position information, and melody information of an introduction, a catchy part, and so forth.

The meta data processing section 21 reads time-based meta data corresponding to the current song and checks the position information of the song according to designated remix pattern information that has been read by the remix pattern reading section 22. For example, knowing the current beat position and the positions of beats of songs to be combined, the meta data processing section 21 decides in what manner to reproduce songs and a sound effect at what timings.

Moreover, in the remix processing section 20, the remix pattern reading section 22 reads a remix pattern file 7*a* stored in the remix pattern storage section 7. The remix pattern file 7*a* is a file that designates whether or not to perform fade-out, whether or not to perform cut-out, and what SE to use. A remix pattern may be a data sequence designated by the user or a third party (commanding in what manner to connect this song) or created according to an automatically creating algorithm (namely, a remix decided on the machine side).

In the synchronous reproduction controlling section 9, the master beat generating section 90 generates a master beat, and sends the master beat to the remix processing section 20, and reproduces a plurality of songs based on individual entries of meta data supplied from the meta data storage section 6 according to the remix process designated by the remix processing section 20 on the basis of a remix pattern and meta data.

Figure 4:
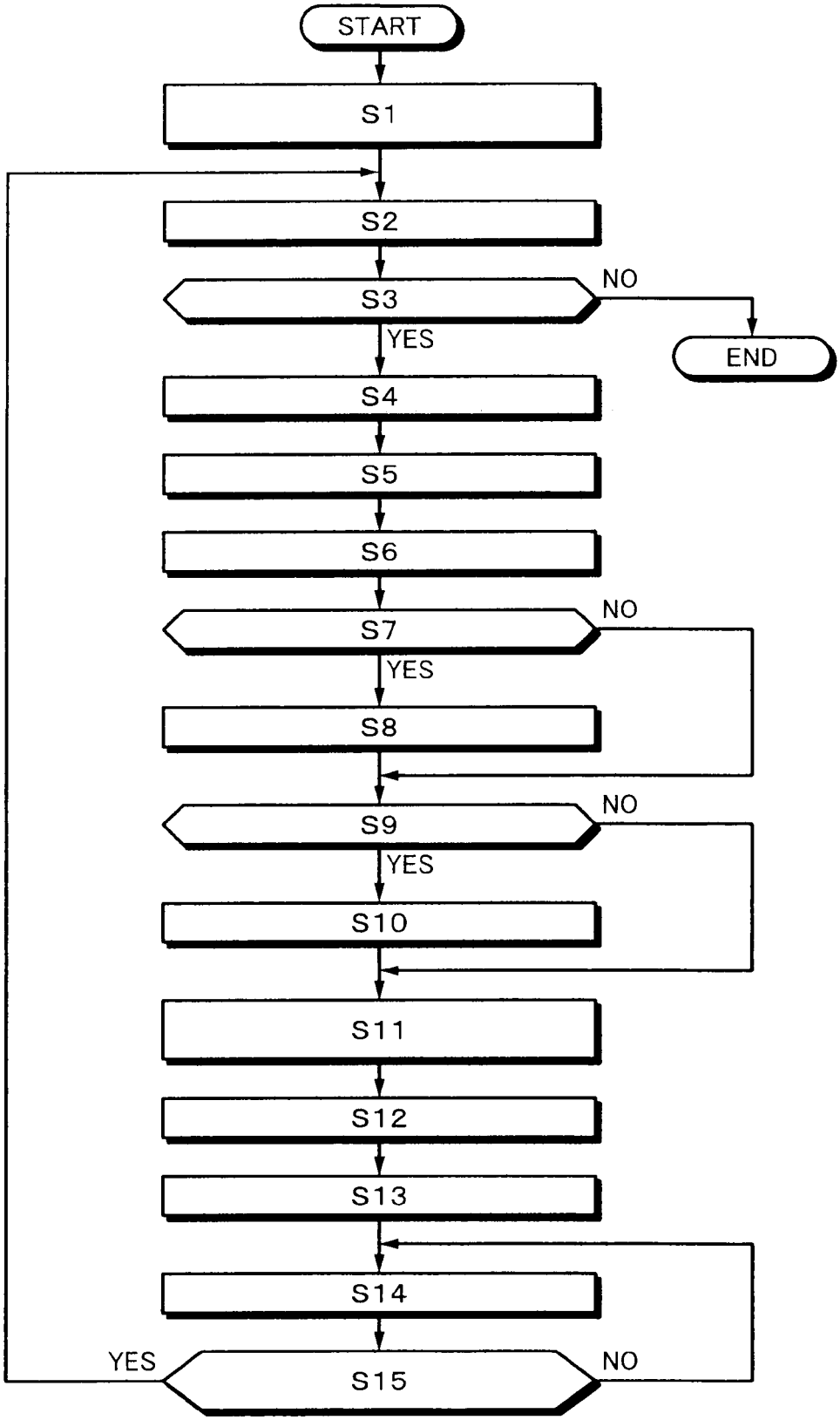
FIG. 4 is a flow chart showing processes of a music editing program that the music editing apparatus executes through a CPU.

FIG. 4 shows processes of a music editing program that the music editing apparatus 1 executes through the CPU 2. This music editing program is an embodiment of the music editing method according to the present invention.

First, in the remix processing section 20 of the CPU 2, the remix pattern reading section 22 reads the remix pattern file 7*a* from the remix pattern storage section 7 and obtains the remix pattern file 7*a* (at step S1). Thereafter, the synchronous reproduction controlling section 9 is caused to obtain a song, for example, a first song (at step S2). When there is another song (YES at step S3), a tempo of the master beat generating section 90 of the synchronous reproduction controlling section 9 is decided (at step S4). The tempo may be fixed at 140 or the user may designate the tempo. Thereafter, a connection pattern (described in the pattern file) is obtained (at step S5).

Since the pattern that connects songs has been decided, meta data of the songs are obtained (at step S6). For example, meta data of song B are obtained. Thereafter, it is determined whether or not the effect process is necessary on the basis of the remix pattern file (at step S7). When necessary (YES), the effect processing section 100 is activated to perform a predetermined effect (at step S8).

Thereafter, it is determined whether or not the sound volume fading process is necessary on the basis of the remix pattern file (at step S9). For example, it is selected whether or not sound volume fade of increasing or decreasing sound volumes of song A and song B that are edited and overlaid is necessary. When necessary (YES), a fade parameter is set (at step S10). Although it has been assumed that sound volumes are automatically increased or decreased, their fade parameters are set.

Thereafter, the original tempos of the songs are set to the master beat generating section 90 of the synchronous reproduction controlling section 9 (at step S11). The original tempos of the songs have been added to meta data of the songs. Thereafter, a free audio signal generating section of the synchronous reproduction controlling section 9 is obtained. In the foregoing specific example, although an example of three channels was described, a free audio signal generating section is obtained and a song to be reproduced is set to the obtained audio signal generating section (at step S13).

After having obtained the current reproduction position of each song (at step S14), it is determined whether or not a point at which the next song is prepared has occurred (at step S15). When SE is, for example, cross-fade, it ends several bars before the relevant bar. When SE is, for example, cut-in, since it immediately starts, it can be prepared one bar before it. Of course, simultaneous reproduction is a reproduction of which songs are simultaneously reproduced. It is determined whether or not such a point has occurred. When a point at which a song is prepared has not occurred, the flow of the processes returns to step S14. At step S14, it is determined whether or not such point has occurred. When a point at which the next song is prepared has occurred (YES), the flow of the processes returns to step S2.

FIG. 5 is a schematic diagram showing time-based meta data 30. As described above, the meta data 30 are time-based auxiliary data added to a song. The meta data 30 describes not only information about a tempo, but position information of beats, bar beginning position information, and melody information of an introduction, a catchy part, and so forth. A bar/beat 31 represents a beat count in the first bar. "11" represents the first beat in the first bar. "14" represents the fourth beat in the first bar. Likewise, "21" represents the first beat in the second bar. In particular, "11" and "21" represent the first beat of each bar. An attribute 32 represents an entity at the position. The attribute 32 represents the position of the beginning of a bar, a normal beat, a melody, a theme (a catchy part), or the like. "01800001" represents the beginning of a bar as an attribute of "11" and "21". When a song has been sampled at 44.1 kHz, the number of samples per second is 44100. The position is described in the unit of a sample. The meta data 30 shown in FIG. 5 are described in the text format or binary format.

Figure 6:
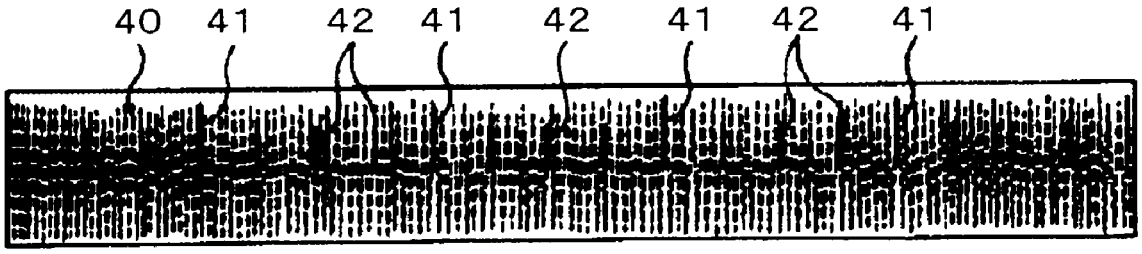
FIG. 6 is a schematic diagram showing a specific example of time-based meta data.

FIG. 6 shows a specific example of time-based meta data. FIG. 6 shows time-based meta data of an audio signal 40 and beats 41 and 42 at a time. The audio signal 40 change left to right as time elapses and the beats ride on the audio signal 40. In FIG. 6, a long line 41 represents a first beat of a bar as a beat signal whereas a short line 42 represents a regular beat as a beat signal. The positions of the first beat 41 of a bar and other beats 42 (three beats at a timing of a quarter note after the beginning of a bar in a four-beat rhythm) are stored corresponding to sample positions of the song.

Figure 7:
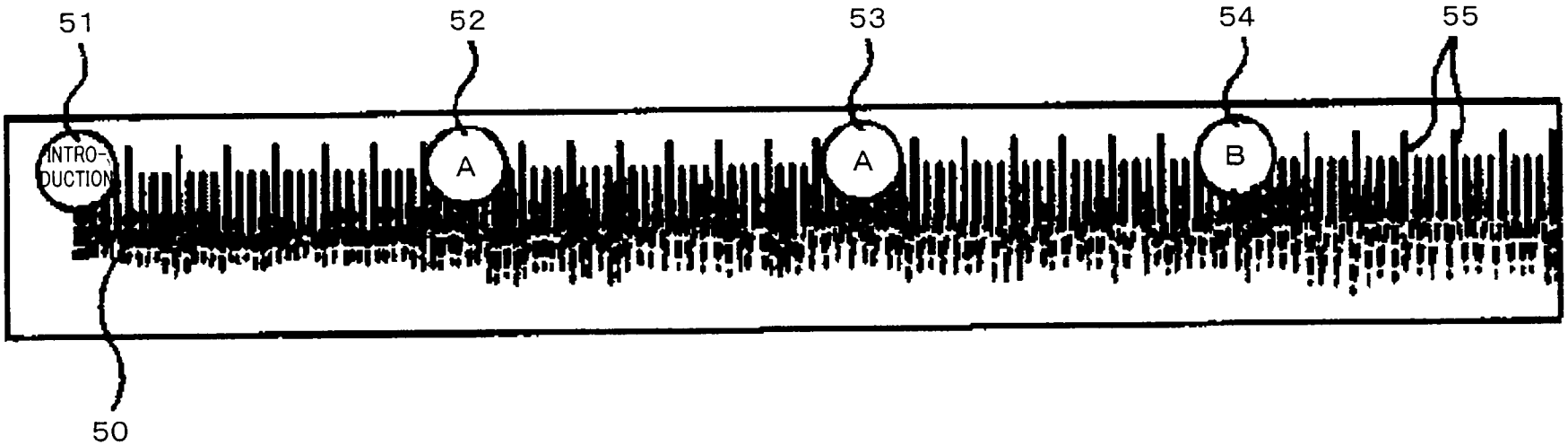
FIG. 7 is a schematic diagram showing another specific example of time-based meta data.

FIG. 7 is a schematic diagram showing another specific example of time-based meta data. An audio signal 50 can contain not only beat positions 55, but position information that represents a melody composition such as an introduction 51, A melodies 52 and 53, a B melody 54, and a theme (a catchy part) of a song. With this information, the positions of bars and the start position of a particular melody of an objective song can be obtained.

Figure 8A:
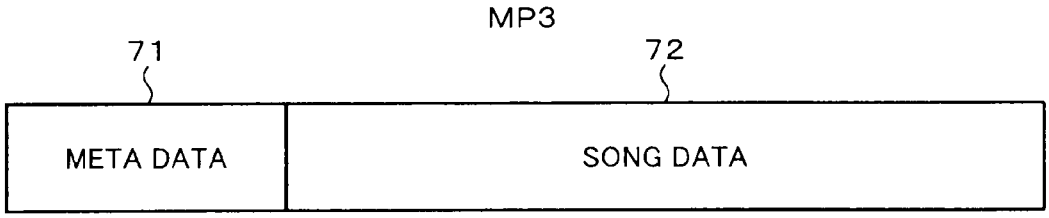
FIG. 8A, FIG. 8B, and FIG. 8C are schematic diagrams showing a method of storing meta data.
Figure 8B:
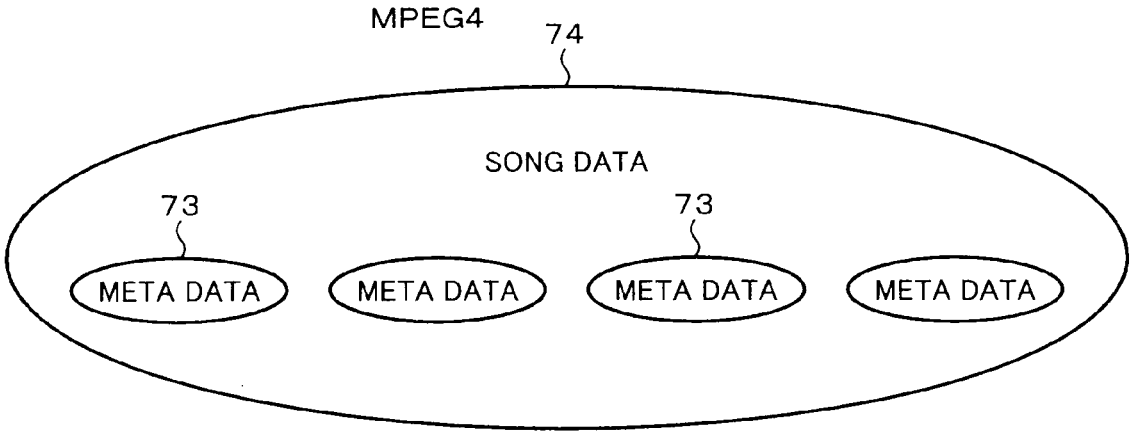
Figure 8C:
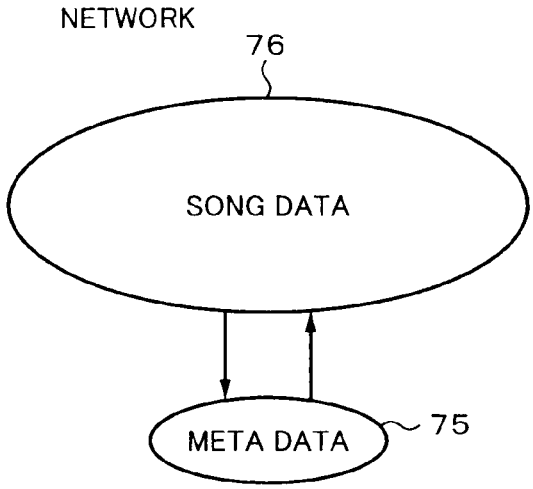

In the music editing apparatus 1 having the structure shown in FIG. 1 and so forth, meta data were stored in the song meta data storage section 6. Instead, meta data may be stored as shown in FIG. 8A, FIG. 8B, and FIG. 8C. FIG. 8A shows an example of which meta data 71 and song data 72 are logically separated and present physically in the same medium as in MP3. FIG. 8B shows an example of which meta data 73 coexist with song data 74 as in MPEG4. FIG. 8C shows an example of which meta data 75 corresponding to song data 76 are retrieved, for example, through a network. In this case, song data and meta data are logically and physically separated from each other. This structure applies to music editing apparatus 80 and 110 (that will be described later) having a network communicating section connected to a network such as the Internet. This structure allows meta data to be downloaded from a site on the network according to a song ID.

FIG. 9 is a schematic diagram showing a specific example of a remix pattern file. Although meta data correspond to one song in one-to-one relationship, the user can freely create a remix pattern. Thus the user can create a remix pattern regardless of songs. A remix pattern file is a file that describes in what manner to connect songs. In a remix pattern 60, ID_A to ID_E of a song ID (file) 61 may be the same as song names A to E, respectively. Instead, ID_A to ID_E may be absolute file names or file paths. A reproduction portion 62 represents what part of each song to reproduce. In this example, a portion of "a catchy part" is designated for song A, a portion of "an introduction" is designed for song B, a portion of "8th bar to 20th bar" is designated for song C, a portion of all is designated for song D, and a portion of "a catchy part" is designated for song E. An (effect) upon reproduction 63 designates what effect to apply to each part of each song. A connecting method (pattern) 64 denotes that song A is cross-fade, song B is connected with cross-fade, song B and song C are connected with cut-in, song C and song D are connected with cross-fade, and song D and song E are connected such that their catchy parts simultaneously reproduced. An (effect) upon connection 65 designates that songs are connected with reverb, low-cut, or distortion as an effect. A connection SE 66 designates a sound effect.

When the pattern shown in FIG. 9 is designated, real reproduction is performed as follows. "The catchy part of ID_A is reproduced. → At the near end of the catchy part of ID_A, the introduction of ID_B is cross-faded. → At the end of the introduction of ID_B, the reproduction of the eighth bar of ID_C is started. → ID_D is cross-faded several bars after 20 bars of ID_C. At the same time, SE_A is also mixed. → When the catchy part of ID_D is reproduced, the catchy part of ID_E is also reproduced."

Thus it can be said that a remix pattern is a conceptual entity of a designation of what parts of songs are connected in what manner is added to a conventional play list.

Figure 32:
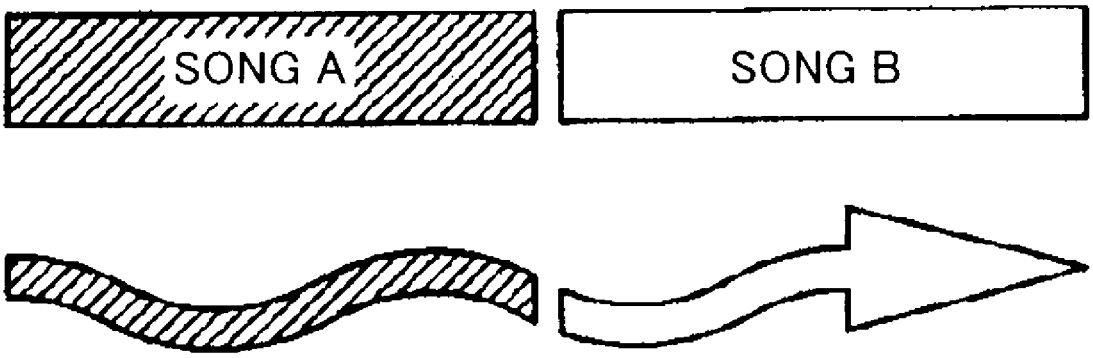
FIG. 32 is a schematic diagram for describing conventional music reproduction.

Next, with reference to FIG. 10 to FIG. 17, a specific example of a method of connecting songs will be described in brief. In the conventional music reproduction, as shown in FIG. 32, two songs A and B are reproduced with their original tempos and it is most likely that there is a non-sound region between two song A and song B. Although songs may be mechanically connected without a non-sound region using a particular reproducing apparatus, many songs have a non-sound region at the beginning and the end. Since these songs partly contain a non-sound region, it is inevitable that there is a non-sound region between these songs.

Figure 10:
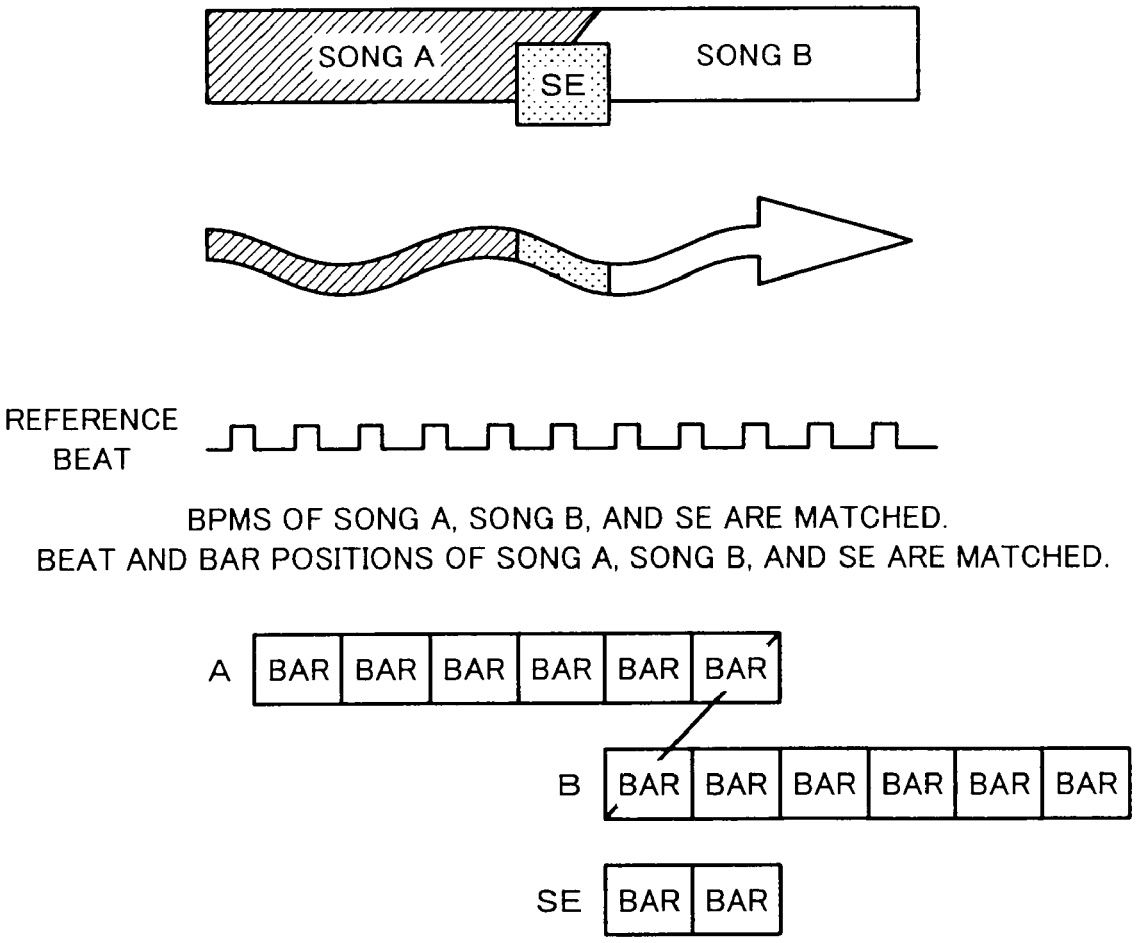
FIG. 10 is a schematic diagram for describing connections with cross-fade using a sound effect.

With the music editing apparatus 1 having the structure shown in FIG. 1, music A and music B can be reproduced in synchronization with a reference beat as shown in FIG. 10. Although the tempo of song A is different from that of song B, they are reproduced with the same tempo. The tempo (oscillation frequency) of the reference beat with which these songs are reproduced can be decided, for example, by a user's setting.

As shown in FIG. 10, each of song A and song B is composed of bars. The length of each bar is equal. In addition, the beginnings of bars are matched. In addition, a sound effect (SE) is music and the beginnings of bars of SE are matched with those of bars of the songs. Since the tempos of song A, song B, and SE are matched, the lengths of bars of song A, song B, and SE are matched. Thus the frequency and phase of song A, song B, and SE are matched. When song A, song B, and SE are connected in such a manner, the user can listen to them in harmony, not cause him or her to feel discomfort.

In addition, in FIG. 10, in the transient part from song A to song B, they are cross-faded while the beginning positions of their beats and bars are synchronized and the two songs are simultaneously generated. Moreover, the sound material of SE is also added. As a result, the transient part from sound A to sound B is further musically modified. Of course, the tempo and beats of the SE are synchronized with the reference beat.

It should be noted that the present invention is not limited to the composition of only song A, song B, and SE. Of course, song C and another SE may be added to such a composition. However, for simplicity of the description, the composition of only song A, song B, and SE will be described in the following.

Figure 11:
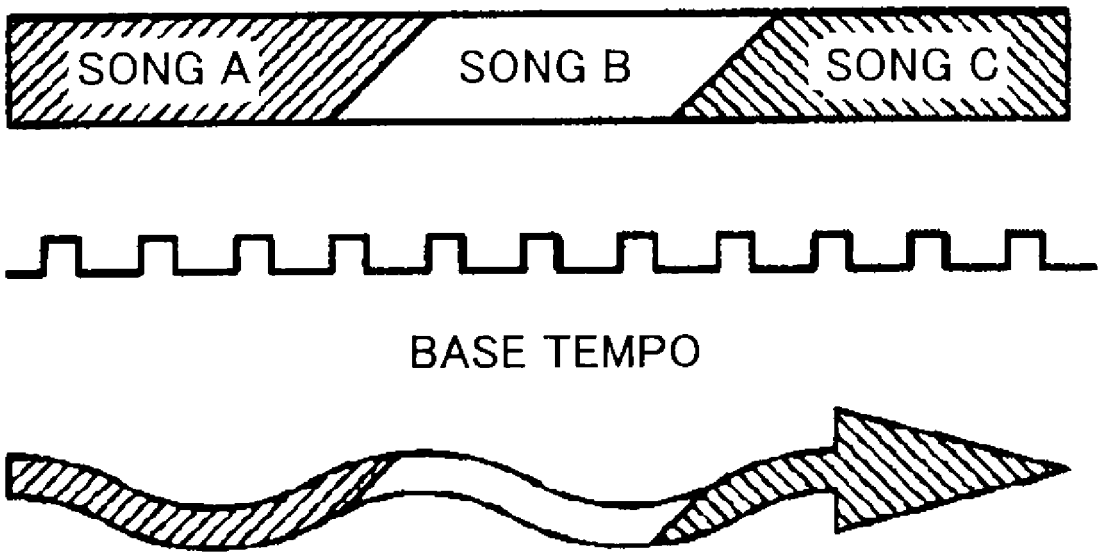
FIG. 11 is a schematic diagram for describing music reproduction according to the present invention.

FIG. 11 shows an example of which song A, song B, and SE are successively reproduced. When the tempos of all songs are matched with the common tempo decided by the user or the system and the songs are reproduced with the matched tempo rather than their original tempos at the matched beat positions (down beat positions) of these songs, they can be seamlessly connected without causing the user to feel discomfort.

To do that, as described above, the music editing apparatus 1 reproduces song A, song B, and song C in such a manner that their beats are synchronized. To reproduce songs having different tempos in such a manner that their beats are synchronized, it is necessary to know their original tempos and their beat positions. In addition, to match the tempos and beat positions of the songs to be reproduced, it is necessary to change the reproduction speeds of the songs.

To know the original tempos and beat positions of the songs, the music editing apparatus 1 uses time-based meta data paired with the songs. When the songs are reproduced, their reproduction speeds are changed on the basis of the ratios of their original tempos and the tempo of the current master beat and the beginning positions of the bars of the songs are matched.

As described above, by accurately handling the tempos and beat positions of the plurality of songs and controlling their reproduction positions in real time, their synchronous reproduction is performed. It is assumed that the technique of seamlessly connecting songs is based on the use of the method of beat synchronous reproduction.

Figure 12:
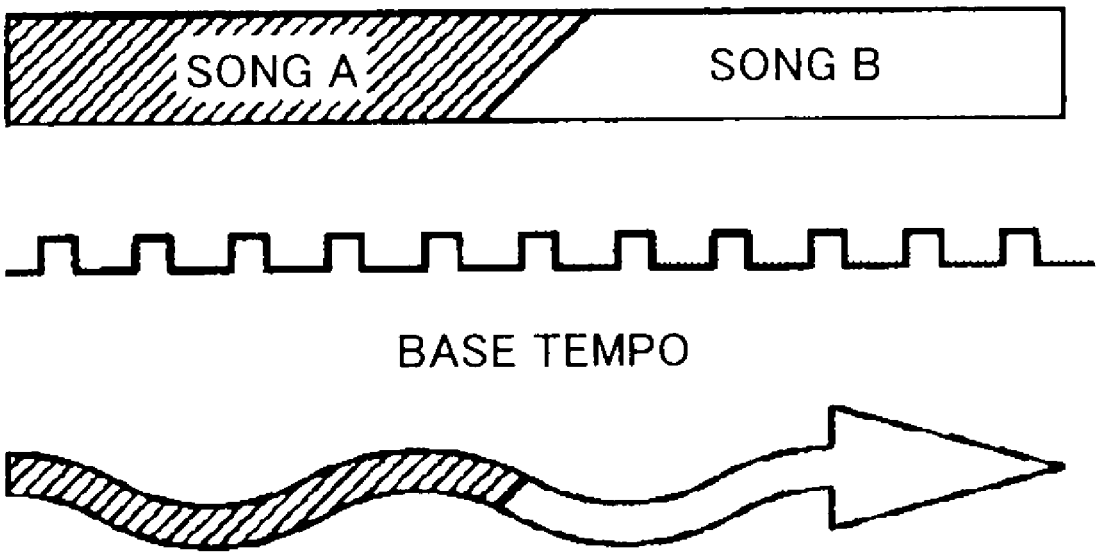
FIG. 12 is a schematic diagram for describing a connection with cross-fade.

FIG. 12 shows an example of which song A and song B are overlaid with their beats matched and they are connected by the cross-fade process. By fading out the current song A (gradually decreasing the sound volume) with the next song B faded in (gradually increasing the sound volume) and simultaneously reproducing both the songs, an effect of which they are seamlessly switched is obtained. Cross-fade is a technique that has been widely used, for example, in FM radio broadcasts. The point of the present invention is in that since the tempos and beat positions of song A and song B are matched, they are seamlessly connected without causing the user to feel discomfort.

Figure 13:
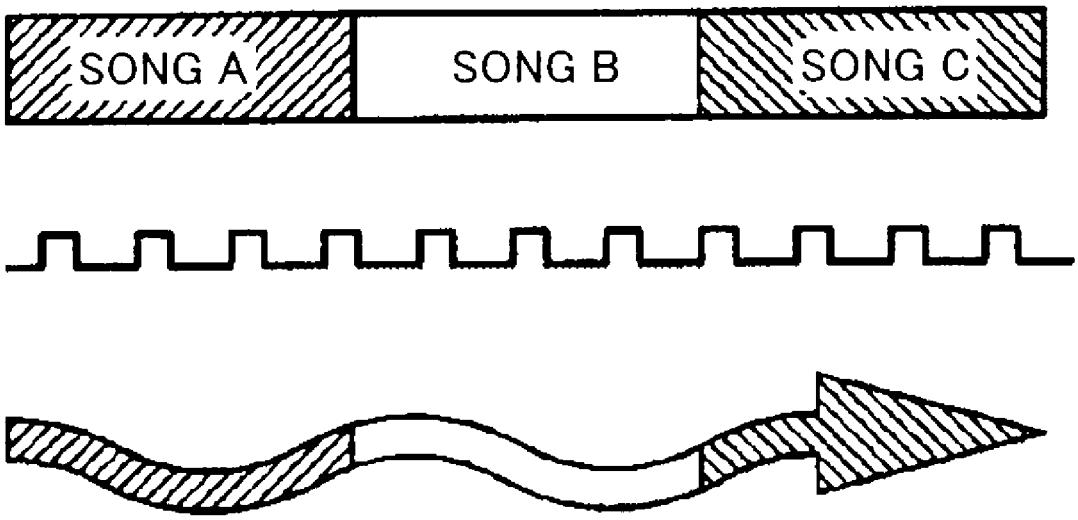

The music editing apparatus 1 can perform a cut-in process that is outlined in FIG. 13. When connections of song A, song B, and song C are musically clear, it may be preferred that they be directly connected as shown in FIG. 13 rather than they are connected with cross-fade. In addition, a song may be intentionally stopped at the end of a beat and the next song may be started at the beginning of the next beat.

Figure 14:
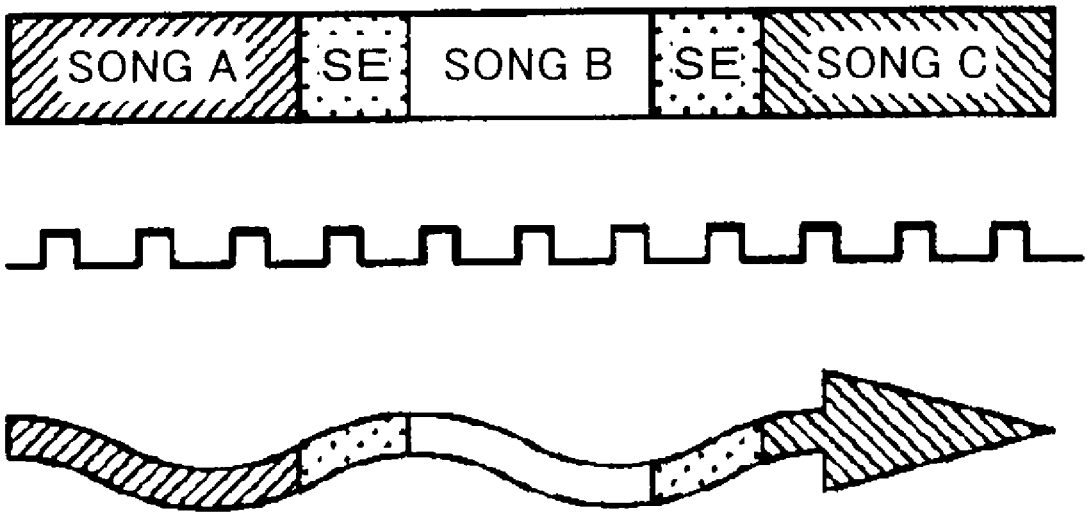
FIG. 14 is a schematic diagram for describing a connection using a sound effect.

The music editing apparatus 1 connects songs with a sound effect (SE) as described above. In other words, a sound effect (SE) can be interposed not only between songs, but at a connecting portion of songs and at any portion of a song. FIG. 14 is an example of which sound effects are interposed between song A and song B and between song B and song C. Of course, in this case, the sound effects can be synchronized with the tempo of the master beat. When SE is interposed or overlaid between songs, songs having much different melodies can be can be more naturally connected.

Figure 15:
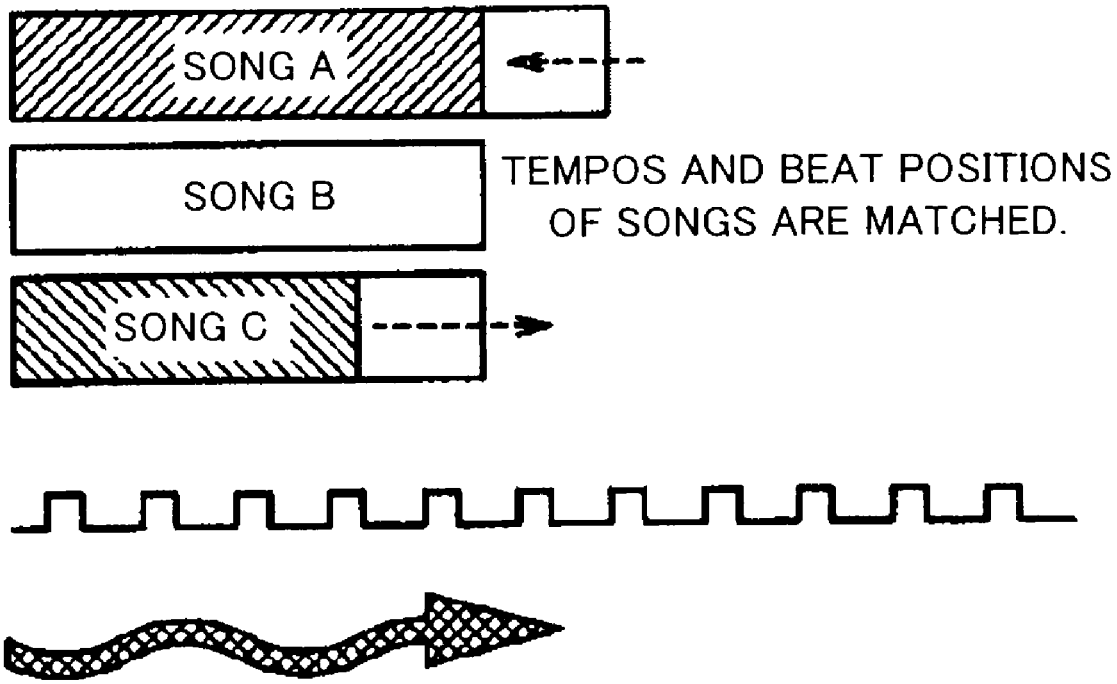
FIG. 15 is a schematic diagram for describing simultaneously synchronous reproduction.

In addition, the music editing apparatus 1 can perform the simultaneous reproduction. In this case, different songs are not only simultaneously reproduced, but their beats are synchronized and the songs are reproduced as shown in FIG. 15. Since the tempos and beat positions of the songs are synchronized, the user may feel as if he or she listened to one song.

Figure 16:
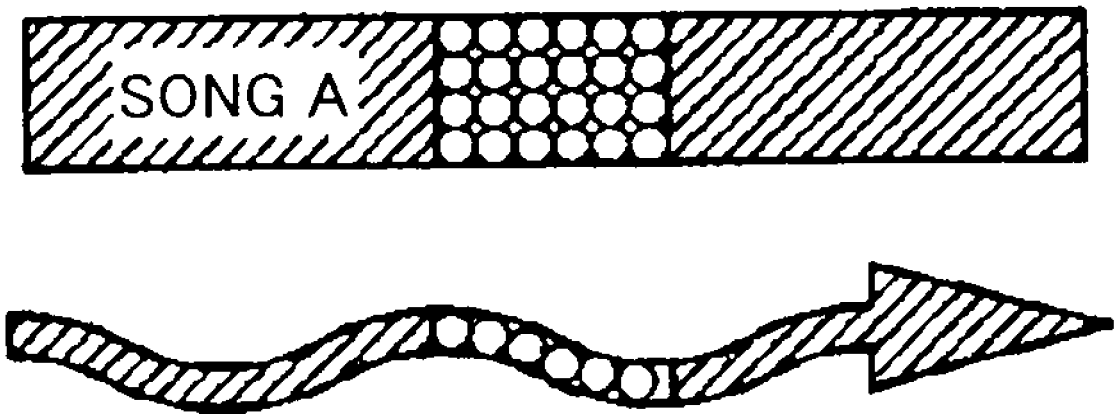
FIG. 16 is a schematic diagram for describing an application of an effect.

In addition, as shown in FIG. 16, the music editing apparatus 1 may apply an effect in one song A. In this case, the music editing apparatus 1 applies an effect (sound effect) to a part or all of sound A to change the sound quality. This sound effect includes not only a process of emphasizing the bass and treble of a song, but a process of changing the tone such as reverb, delay, distortion, or maximizer.

While applying reverb as an effect to music A and low-cut filter as an effect to music B, when these songs are simultaneously reproduced or connected in various manners, more natural and attractive connecting methods can be accomplished.

Figure 17:
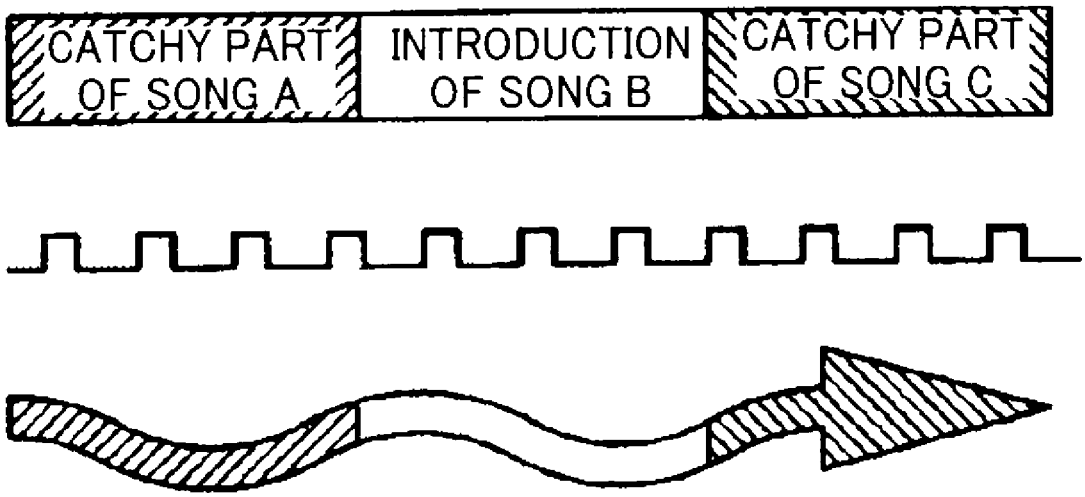
FIG. 17 is a schematic diagram for describing partial reproduction.

In addition, the music editing apparatus 1 may apply the foregoing connecting methods not only to a whole song, but to a catchy part or an introduction of each song as shown in FIG. 17. When parts of songs are connected, for example, only catchy parts may be remixed.

As described above, the music editing apparatus 1 can seamlessly remix songs based on a remix pattern file that describes a remix pattern. In this case, the music editing apparatus 1 may decide the tempo of the master beat that the user has designated or match the tempos of songs with the tempo of a main song. Instead, with an acceleration sensor or the like, the music editing apparatus 1 may measure the walking tempo or jogging tempo of the user and decide the tempo of the master beat corresponding to the measured tempo.

Thus, with the music editing apparatus 1, the user can enjoy music not only in the conventional manner, but in the following new type manner. Unlike the conventional manner, this new type manner cannot be achieved only by passively listening to music. This new type manner allows the user to actively concern himself or herself in music, create a music listening method corresponding to his or her lifestyle, and satisfy his or her exhibitionism.

In other words, the user can stylishly connect his or her favorite parts of songs and listen to them as seamless remix music. In addition, with the music editing apparatus 1, the user can satisfy his or her creative desire for selecting a connecting method of songs on try-and-error basis and stylishly creating a remix.

Figure 18:
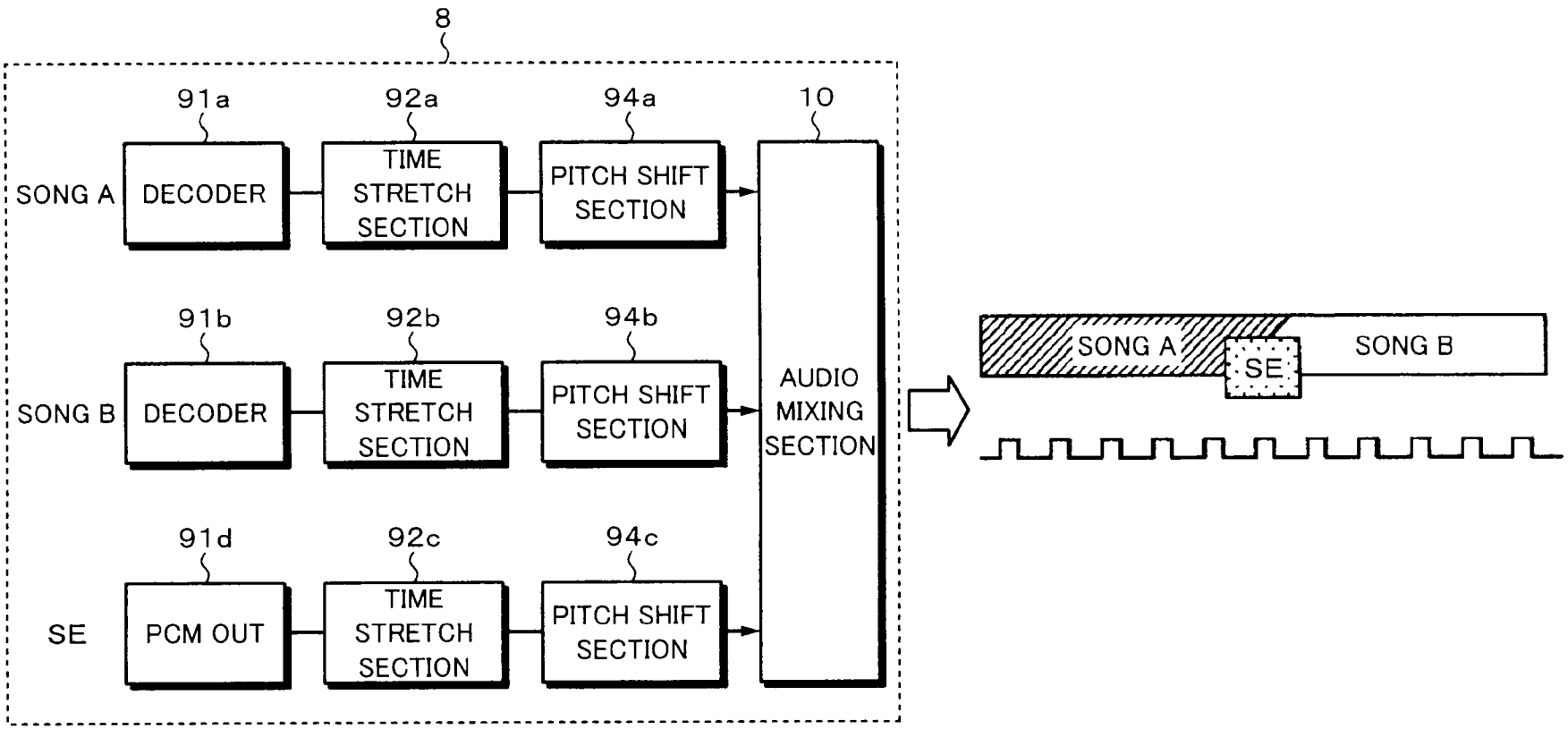
FIG. 18 is a schematic diagram showing a structure of a synchronous reproducing section that can edit and reproduce song A and song B shown in FIG. 10 in such a manner that they are cross-faded and overlaid with SE.

FIG. 18 shows a structure of the synchronous reproducing section 8 that can edit and reproduce song A and song B shown in FIG. 10 such that song A and song B are cross-faded and overlaid with SE. As shown in FIG. 2, the synchronous reproduction controlling section 9 has three (tracks of) audio signal generating sections and an audio mixing section 10.

These tracks correspond to song A, song B, and SE. The number of tracks depends on the number of songs composed. For these tracks, functions of decoders 91*a*, 91*b*, time stretch sections 92*a*, 92*b*, and 92*c*, and bit shift sections 94*a*, 94*b*, and 94*c* are provided. The decoders decode compressed audios that have been compressed according to MP3, ATRAC, or the like and output decompressed audio as PCM data. Since the length of SE is short and the data size thereof is small, it does not always need to be compressed. Thus the decoder for the SE track is omitted and a PCM out 91*d* is used instead.

The time stretch sections convert the reproduction speed of the corresponding song or SE with the interval kept constant. The time stretch sections are used to match the different tempos of the song materials with the tempo of the reference beat. The pitch shift sections change the interval of the corresponding song or SE with the reproduction speed kept constant. The pitch shift sections are used to musically harmonize song materials having different keys and pitches. However, the pitch shift sections are not essential functions, but additional functions.

Figure 19:
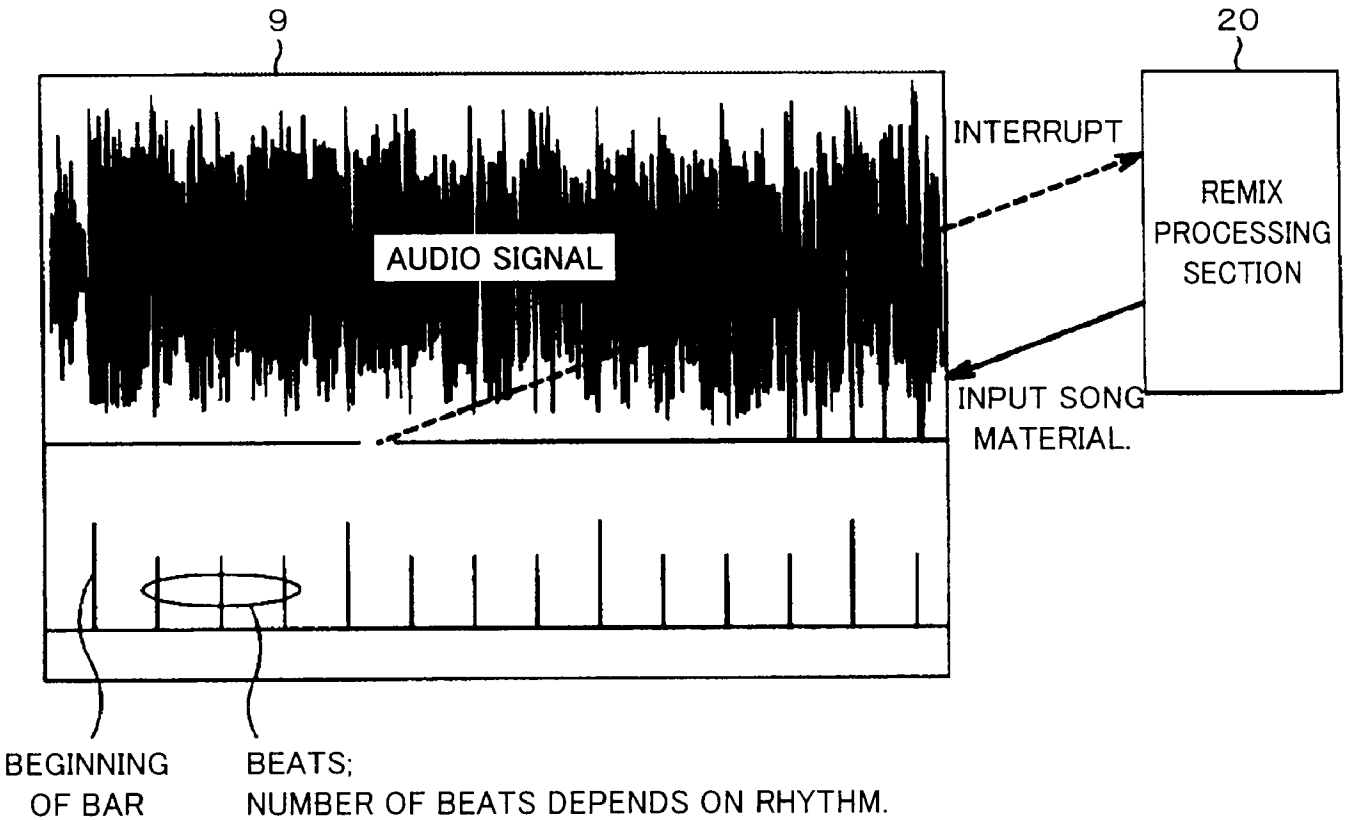
FIG. 19 is a schematic diagram for describing functions of a synchronous reproduction controlling section and a remix processing section that are principal sections of the present invention.

FIG. 19 is a schematic diagram for describing functions of the synchronous reproduction controlling section 9 and the remix processing section 20 as principal sections of the present invention. The remix processing section 20 selects a song to be reproduced and causes the synchronous reproduction controlling section 9 to reproduce the selected song. In this case, the remix processing section 20 may cause the synchronous reproduction controlling section 9 to reproduce a part or whole of the song. In the example shown in FIG. 10, the remix processing section 20 selects song A, song B, or SE and designates a reproduction timing for the selected song or SE.

The synchronous reproduction controlling section 9 reproduces the song material selected by the remix processing section 20 in synchronization with the reference beat. The synchronous reproduction controlling section 9 reproduces a music signal in synchronization with a self-generated clock signal. A clock signal is a clock corresponding to a beat generated in the synchronous reproduction controlling section 9. The synchronous reproduction controlling section 9 supplies an interrupt of a clock's leading edge to the remix processing section 20. The remix processing section 20 counts the interrupts as triggers and obtains a bar count and a beat count starting from the beginning. Since the remix processing section 20 continuously counts up the clock with interrupts, it can know timings of supplying song A and song B. Thus the remix processing section 20 causes the synchronous reproduction controlling section 9 to reproduce them at the timings.

Unlike the conventional music editing apparatus 1, the synchronous reproduction controlling section 9 is not a simple audio signal reproducing section. Instead, the synchronous reproduction controlling section 9 is a section that also generates a clock corresponding to a beat. The synchronous reproduction controlling section 9 supplies the clock to the remix processing section 20 to interrupt it.

Thus the reference beat is composed of a trigger signal that represents the beginning of a bar and a beat signal that represents a beat. The number of beats per bar depends on a rhythm (for example, four-four rhythm). The reference beat is supplied as an interrupt signal to the remix processing section 20. The remix processing section 20 counts the clock and obtains a bar count and a beat count as the current reproduction position. In addition, the reference beat can be used as a timing signal for supplying a song material.

Figure 20:
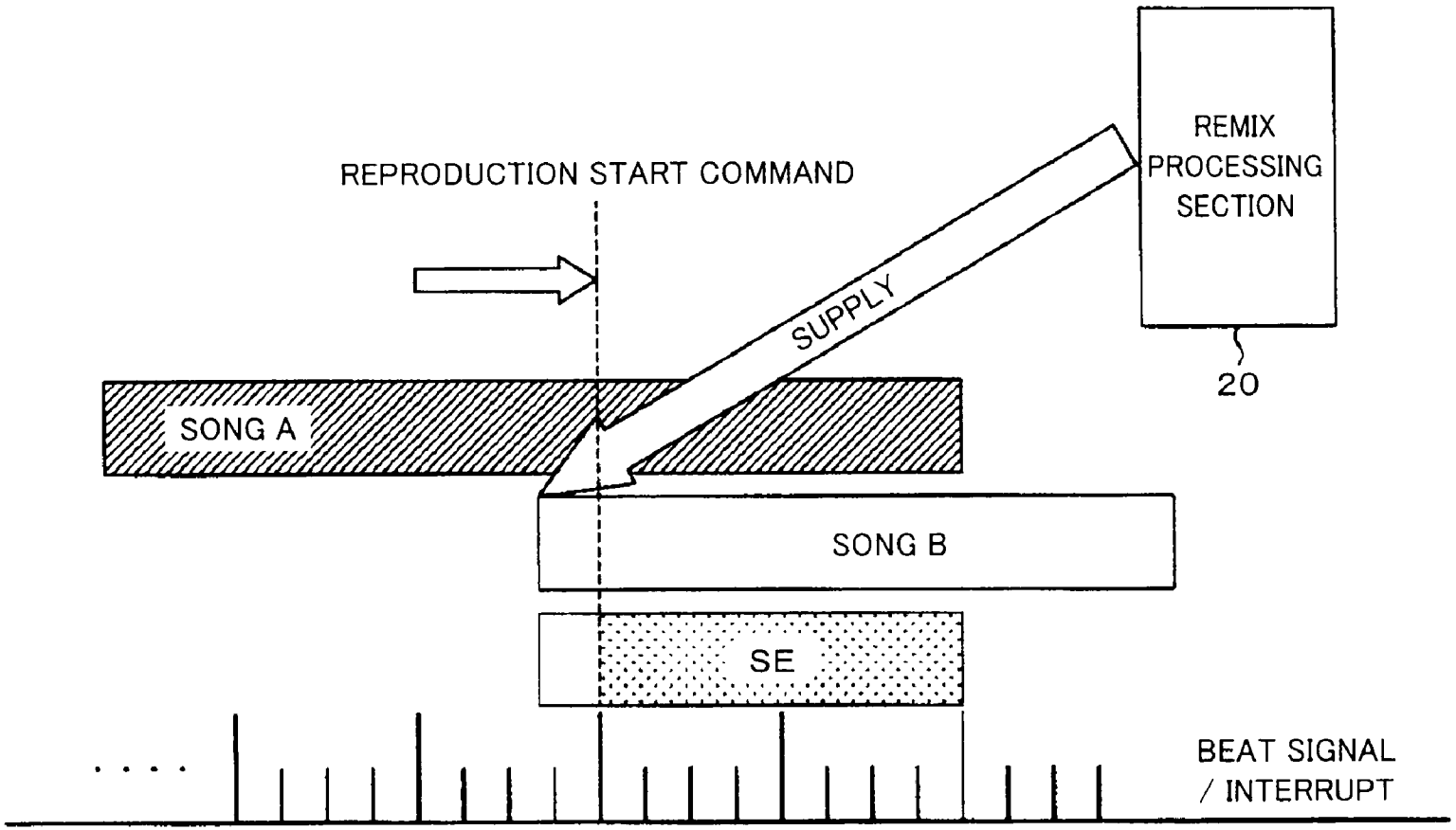
FIG. 20 is a schematic diagram showing a mechanism of the beat synchronous reproduction.

FIG. 20 shows a mechanism for the beat synchronous reproduction. In this example, music beats of song materials are synchronized, in particular, first beats of bars of song materials are synchronized. It should be noted that the beat synchronous reproduction may not be based on the first beats of bars. Instead, the beat synchronous reproduction may be based on regular beats or fine beats such as those of a 16-beat rhythm.

The remix processing section 20 pre-obtains the timings of the first beats of bars as the reference beats that are interrupt signals. The remix processing section 20 pre-selects a song material to be reproduced next and supplies the selected song material to the synchronous reproduction controlling section 9 at a timing immediately before the first beat of the next bar from which the song material is to be reproduced.

Thereafter, the synchronous reproduction controlling section 9 starts reproducing the song material at the timing of the first beat of the next bar. Likewise, all song materials are started to be reproduced in synchronization with the reference beat. Thus, for example, song A, song B, and SE can be synchronously reproduced.

Specifically, in FIG. 20, song A, song B, and SE are cross-faded. FIG. 20 is a timing chart of connecting portions that are cross-faded. When song A is reproduced from the beginning and then it is cross-faded at the beginning of a bar, song B needs to be reproduced at the beginning of the bar. Although SE also needs to be reproduced at the beginning of the bar, since a preparation period such as setup time is necessary, song B and the SE cannot be quickly reproduced due to access time and other factors. Thus a preparation state is necessary to some extent. In other words, a blank region is necessary. When the remix processing section 20 issues a command at a timing of the immediately preceding bar to cause the synchronous reproduction controlling section 9 to start reproducing song materials at the beginning of the next bar, the synchronous reproduction controlling section 9 starts reproducing the song materials at the beginning of the next bar.

In other words, although the remix processing section 20 controls processes at rough timings, the synchronous reproduction controlling section 9 performs processes corresponding to commands at very fine timings.

Thus, in the music editing apparatus 1, the synchronous reproduction controlling section 9 generates a clock by itself and reproduces song materials at timings exactly in synchronization with the clock. The remix processing section 20 functions as a system controlling section that controls the whole system. The remix processing section 20 controls the system at rough timings. In other words, while the remix processing section 20 issues commands to the synchronous reproduction controlling section 9 at rough timings, the synchronous reproduction controlling section 9 exactly performs processes corresponding to the commands.

Figure 21:
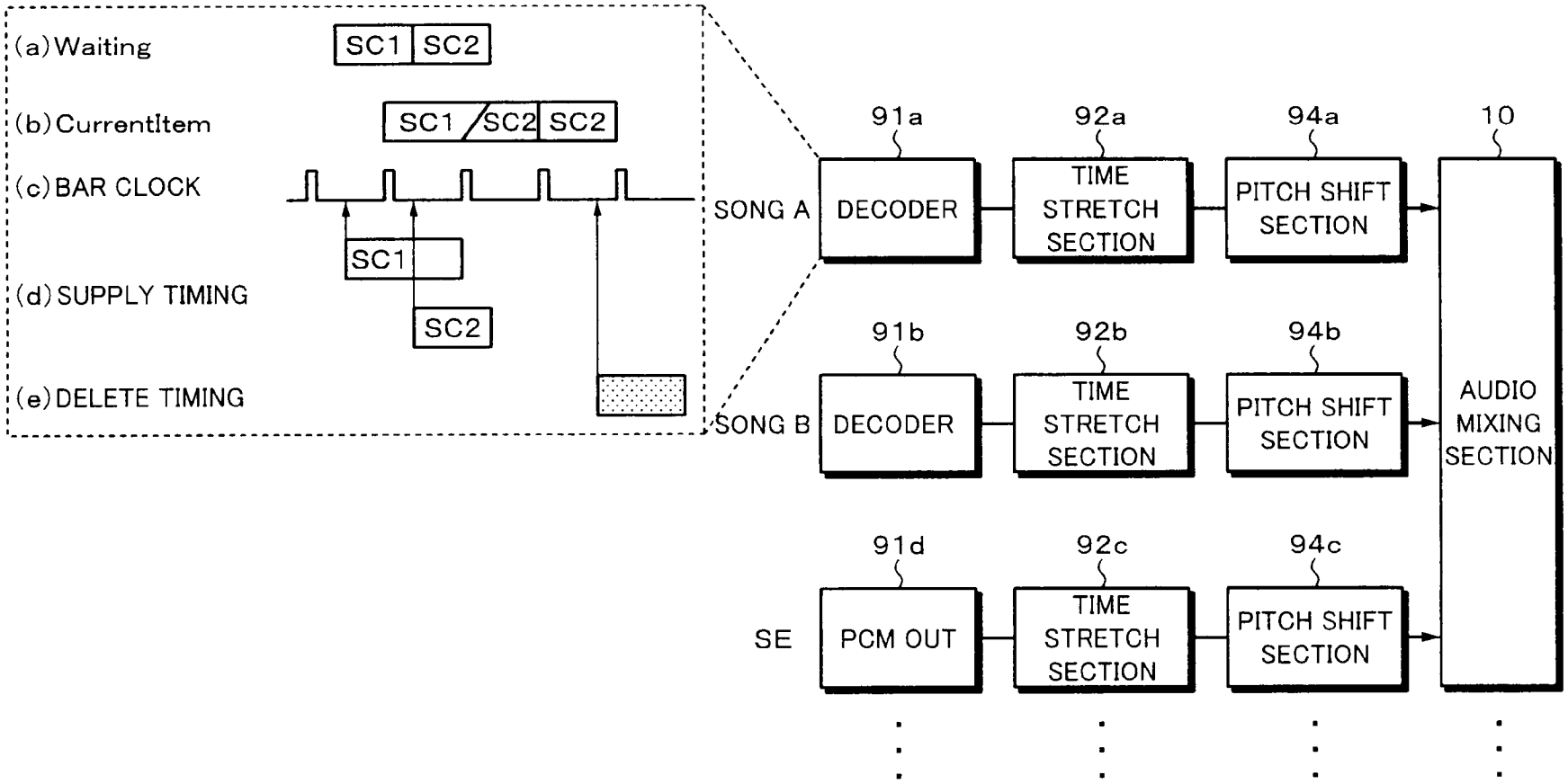
FIG. 21 is a schematic diagram showing a detailed timing chart of the beat synchronous reproduction.

FIG. 21 shows a detailed timing chart of the beat synchronous reproduction. The remix processing section 20 prepares song materials to be supplied to all the three tracks. In addition, since the remix processing section 20 has received the reference beat as an interrupt, the remix processing section 20 can know at what timings to supply the song materials to the tracks. Song materials SC1 and SC2 that have been supplied are temporarily stored in (a) waiting region of the synchronous reproduction controlling section 9. At the timing of the first beat of the next bar, they are temporarily loaded to (b) current item region and then they are started to be reproduced. In this example, SC1 is started to be faded out at the timing of the first beat of (c) bar clock whereas SC2 is started to be faded in. As shown in (d) supply timing, SC1 is stopped to be reproduced after it is faded out whereas SC2 is started to be loop-reproduced at the first beat of the next bar. The fade-in, fade-out, loop reproduction ON/OFF, number of repetitions of loop reproduction, and so forth are commanded by the remix processing section 20 and executed by the synchronous reproduction controlling section 9. The supplied song material can be stopped to be reproduced at the first beat of the next bar corresponding to a delete command (e) supplied from the remix processing section 20.

The synchronous reproduction controlling section 9 executes all commands supplied from the remix processing section 20 in synchronization with the reference beat. In this example, the reference beat as a synchronous mode is the first beat of a bar. Instead, commands may be synchronized with a regular beat or a fine beat such as a beat of a 16-beat rhythm. When the synchronous mode is OFF, the synchronous reproduction controlling section 9 immediately starts reproducing song materials corresponding to a command supplied from the remix processing section 20. The synchronous mode is commanded to the synchronous reproduction controlling section 9 by the remix processing section 20.

Figure 22:
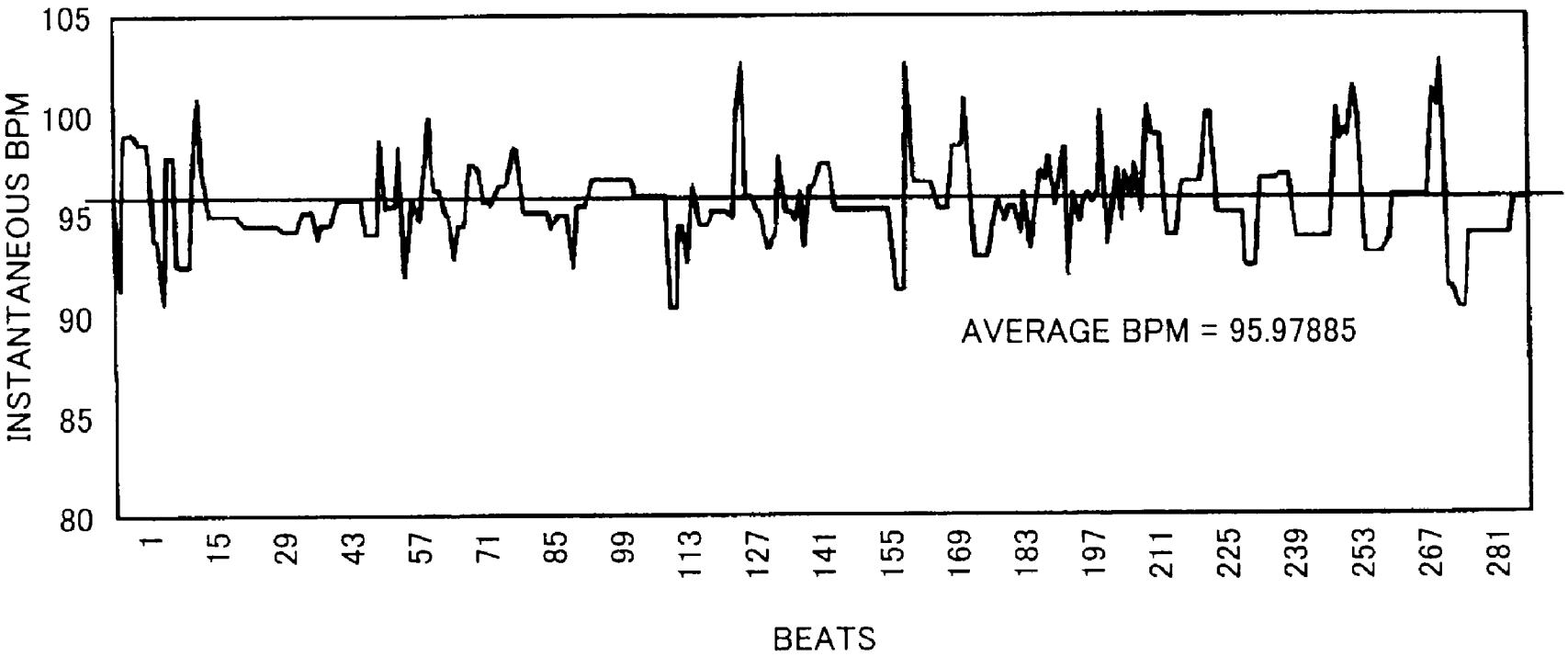
FIG. 22 is a schematic diagram showing an example of changes of the tempo of a particular song.

FIG. 22 shows an example of changes of the tempo of a particular song. The horizontal axis represents beats, whereas the vertical axis represents instantaneous BPM. This example involves a problem to be solved by the present invention. The tempo of real music largely changes depending on the skills and intentions of the performers. In this example, although the average BPM is approximately 96, the tempo of a song changes by approximately 10 BPM. The change width and pattern largely depend on songs. Thus it is difficult to quantize and stabilize them.

As exemplified in FIG. 21, although the reproduction start timing of each song material can be exactly controlled, the beats of music always change. Thus, when a song material is continuously reproduced, the beats of the song gradually change from the reference beat. These changes tend to become several ten m/sec in several seconds to several ten seconds after the start of reproduction. As a result, the changes of the rhythms of song A, song B, and SE amount to a level that a person as a listener can sense. It is necessary to correct the musically unnatural changes of the rhythms by any means.

Figure 23C:
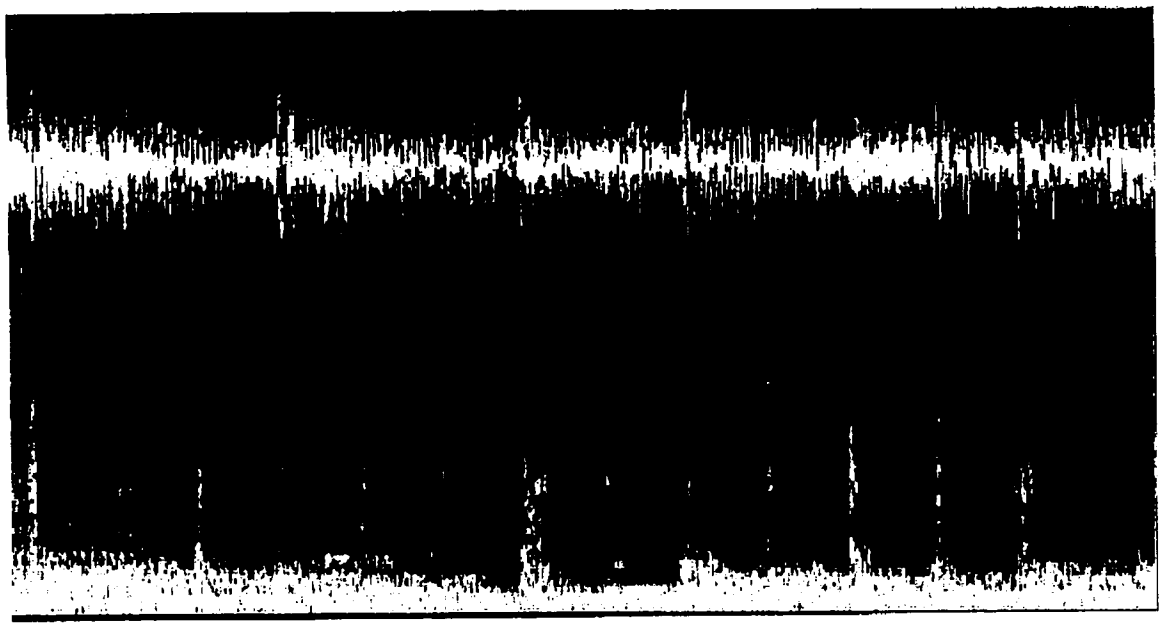
Figure 23C:
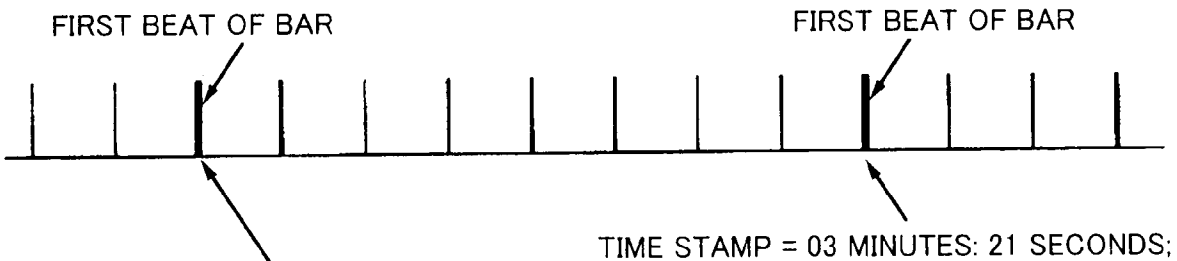

FIG. 23A, FIG. 23B, and FIG. 23C show a concept of a method of solving such a problem. Since the tempo and beat interval of a real song always change, time line meta data that contain time stamps of their beats are pre-created.

By spectrum-analyzing (FIG. 23B) a time waveform (FIG. 23A) of a song and obtaining peaks therefrom, beats (FIG. 23C) are obtained. These beats are equivalent to a quarter note. The position of the quarter note is time-stamped and the beat positions are recoded. In such a manner, time line meta data (also simply referred to as meta data) are created. Specifically, changing beats contained in original music data are also recorded. Such beats are included in meta data. In other words, a time waveform that contains beat positions is called meta data.

Figure 24:
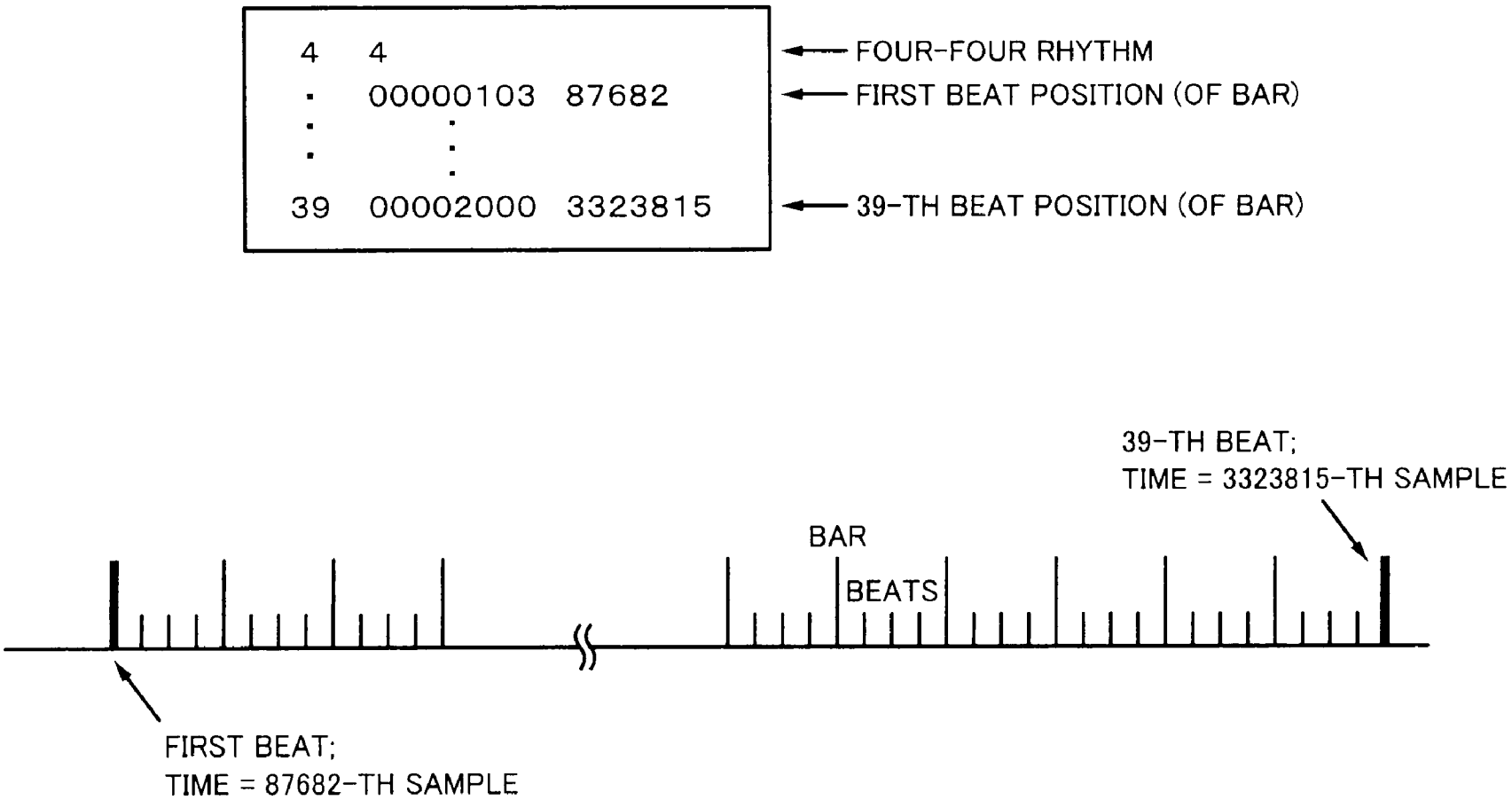
FIG. 24 is a schematic diagram showing a descriptive example of time line meta data.

FIG. 24 shows a descriptive example of time line meta data. Time line meta data describe beat positions just corresponding to a PCM waveform file of a song. Time stamps on the music waveform corresponding to beat positions of the first beats and other beats of bars are recorded as time codes, for example, sample counts starting from the beginning. Since time line meta data describe just time stamps, the data size is as small as one several thousandsth or one several ten thousandsth of that of the original PCM data. Specifically, when a song material has a four-four rhythm, at the 39-th beat positions of the song, there is a time stamp of 3323815. Based on this time stamp and the audio signal, the synchronous reproduction controlling section 9 generates this clock.

Figure 25:
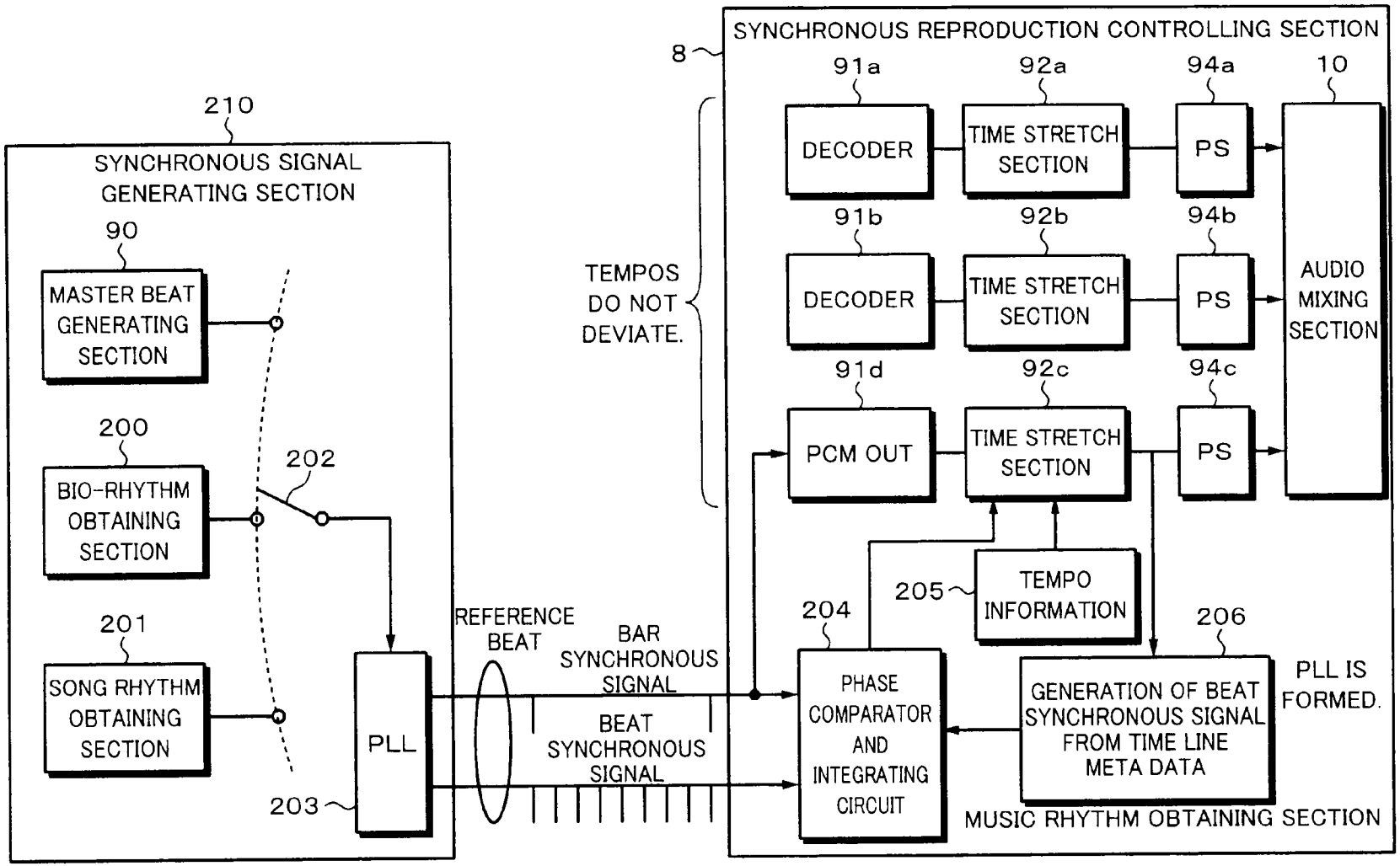
FIG. 25 is a schematic diagram showing a structure of a system that performs reproduction in synchronization with music beats that always change.

FIG. 25 is a schematic diagram showing a structure of a system that solves the problem of a synchronous signal generating section 210. The system reproduces a song in synchronization with music beats that always change. The synchronous signal generating section 210 (a master beat generating section 90, a biorhythm obtaining section 200, and a music rhythm obtaining section 201) generates a bar synchronous signal and a beat synchronous signal that become a reference beat and inputs them to a synchronous reproduction controlling section 9 of a synchronous reproducing section 8. In the synchronous reproduction controlling section 9, a music rhythm obtaining section 206 generates a beat synchronous signal corresponding to the beats of the current song in synchronization with the reproduction of the song from time line meta data of the song. A phase comparator and integrating circuit 204 compares the phase of the beat synchronous signal generated from the time line meta data with that of the reference beat and outputs the resultant difference as a phase error signal. The phase error signal is integrated by an integrating circuit of the circuit 204 and input as a tempo correction amount to a time stretch section 92*c*. The tempo correction amount causes the time stretch section 92*c* to minimize the phase error of the system and forms a negative feedback of the system. The tempo correction amount is equivalent to a conventional PLL circuit. The PLL circuit is formed for each track. The PLL circuits always control feedbacks such that the music beats of the reproduced song of each track are phase-locked to the reference beat. As a result, the beat phases of all the tracks are matched. Thus songs can be reproduced for a long time without changes of tempos and beat phases.

It is assumed that three types of music of song A, song B, and SE are simultaneously reproduced. To lock their frequencies and phases, a master clock is prepared. The master clock is generated by the master beat generating section 90. The master beat generating section 90 is disposed in the synchronous signal generating section 210. The master beat generating section 90 is a simple oscillating circuit. The synchronous reproduction controlling section 9 of the synchronous reproducing section 8 follows the beats of the music in synchronization with the master clock. The master bit is, for example, 120 BPM. The three types of reproducing sections controls feedbacks such that their phases are synchronized with the phase of the clock and the error of the reproduction tempos does not cumulate. The music rhythm obtaining section 206 generates a beat synchronous signal from the time line meta data. The phase comparator and integrating circuit 204 compares the phase and frequency of the generated beats with those of the master clock. A negative feedback is performed to prevent the error from cumulating. The tempo of the time stretch is delicately adjusted such that when the tempo becomes slower than the master clock, the tempo is increased and when the tempo becomes faster than the master clock, the tempo is decreased. In other words, the reproduction of music is synchronized with the master clock.

Figures 26A, 26B, 26C, 26D:
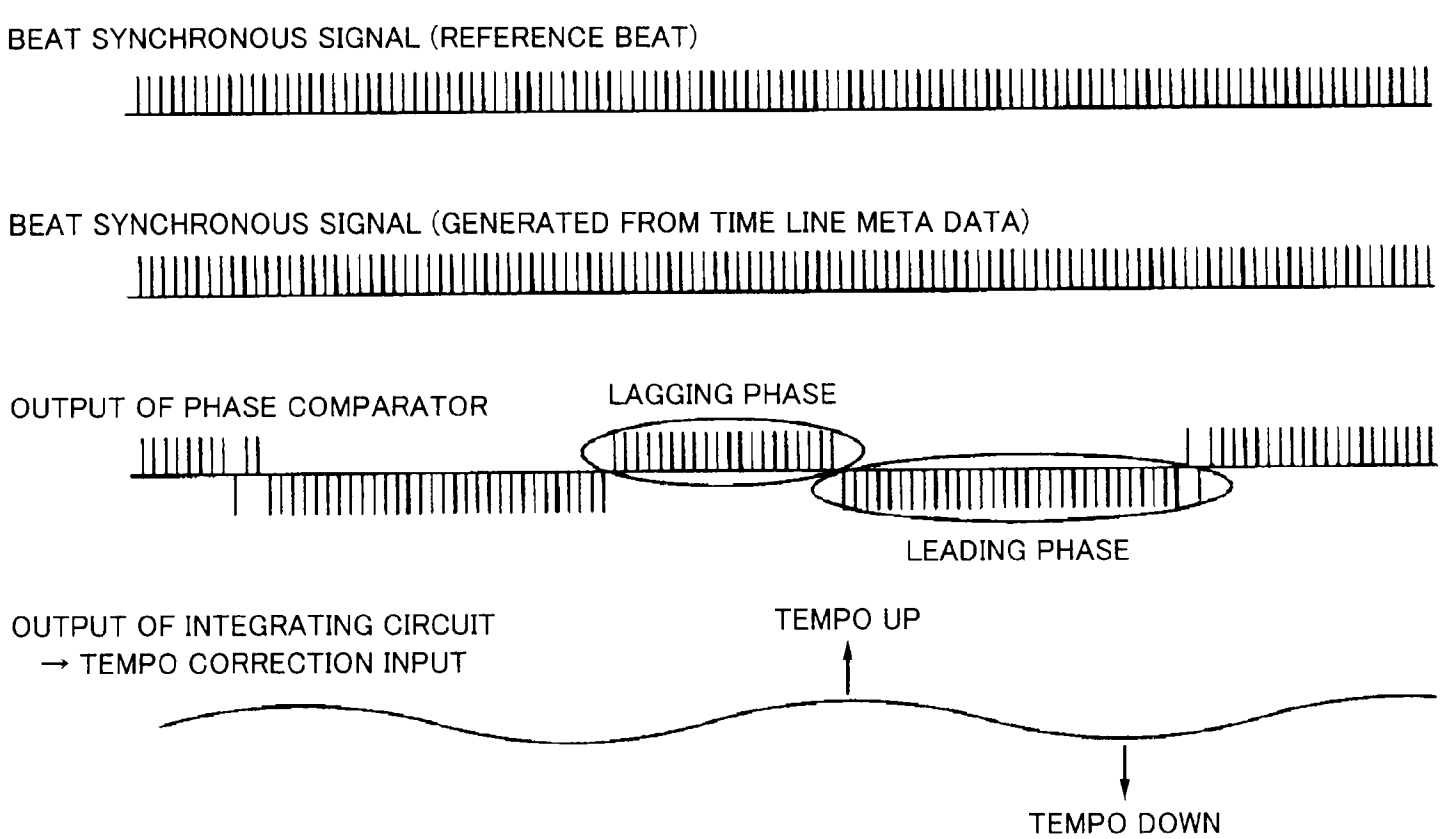
FIG. 26A, FIG. 26B, FIG. 26C, and FIG. 26D are schematic diagrams showing output waveforms of a PLL for describing a synchronizing method using time line meta data.

FIG. 26A, FIG. 26B, FIG. 26C, and FIG. 26D show output waveforms of a real PLL operation to describe a synchronizing method using time line meta data. A phase comparator compares the phase of a beat synchronous signal (FIG. 26A) of a reference beat with that of a beat synchronous signal (FIG. 26B) generated from the time line meta data. As an output (FIG. 26C) of the phase comparator, a positive output pulse train can be obtained when the phase is lagging and a negative output train can be obtained when the phase is leading. The output pulse train is integrated by an integrating circuit and converted into a tempo correction input value as a DC value (FIG. 26D). The tempo correction input value is input to a time stretch section. The time stretch section converts the reproduction speed such that when the value is positive, the tempo is increased and when the value is negative, the tempo is decreased. Thus a negative feedback control is performed such that the phases of beats of all songs are locked with the phase of the reference beat.

To put it in more detail, with the time line meta data, a beat synchronous signal corresponding to beats of the current music is generated, compared with the master clock, and fed back such that the phase of the current music does not deviate from that of the master clock. Thus songs can be reproduced for a long time without changes of their phases.

Thus, when the music editing apparatus 1 reproduces songs having different tempos and rhythms as a remix, even if the beats of the original music change, the beat synchronous reproduction can be automatically performed for them in real time such that their tempos and rhythms are kept constant.

Figure 27:
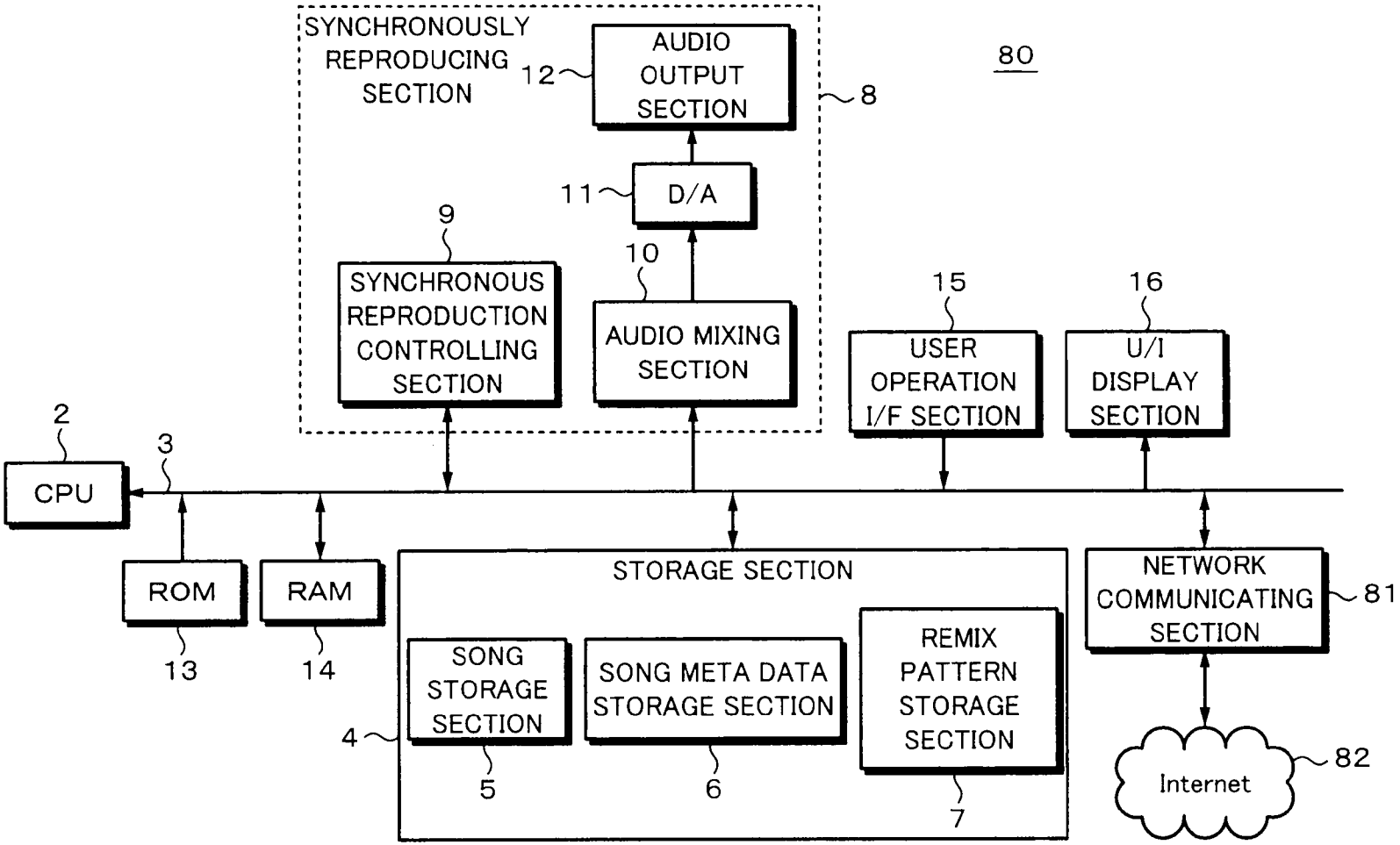
FIG. 27 is a schematic diagram showing a structure of a music editing apparatus having a network communicating section.
Figure 28:
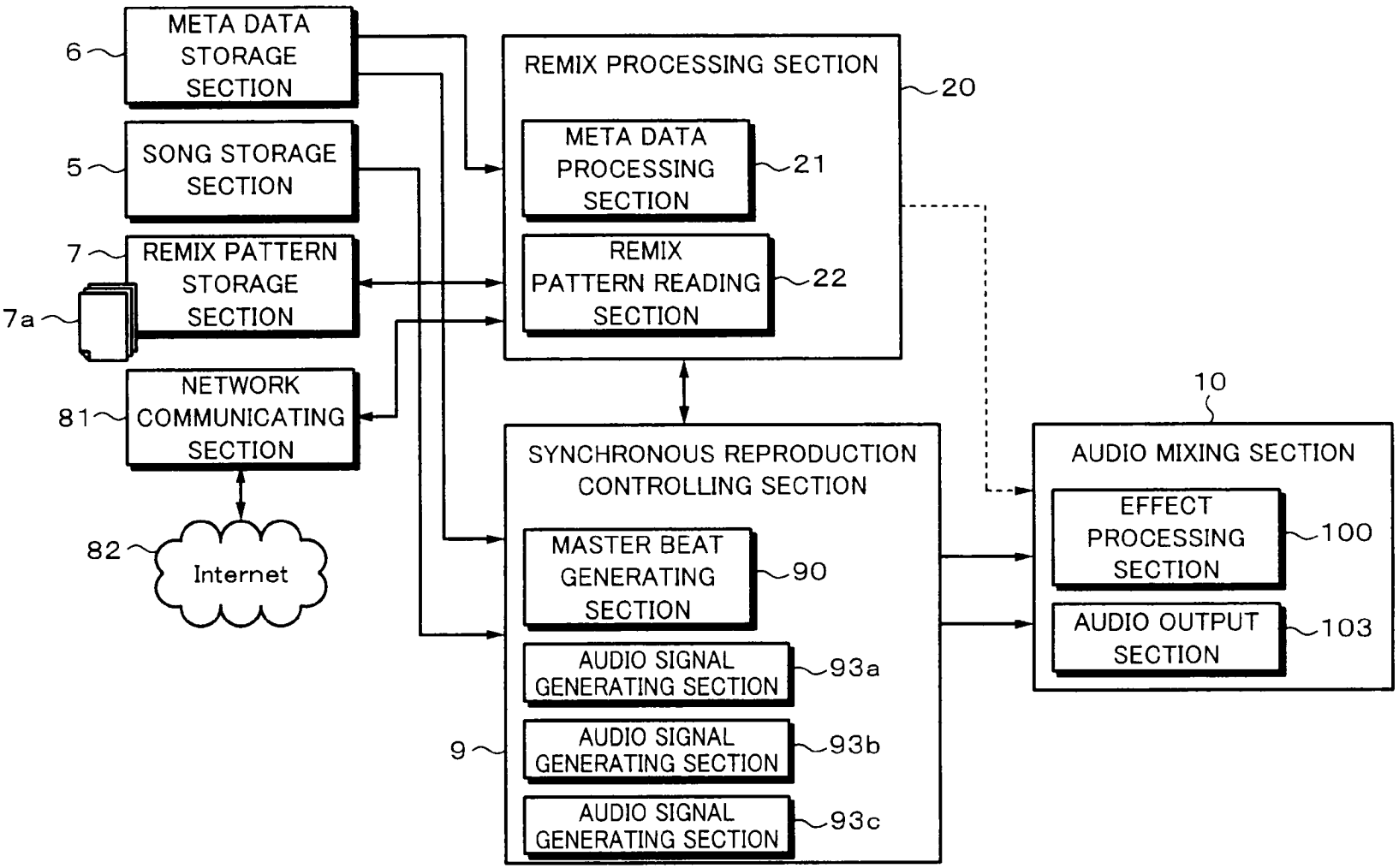
FIG. 28 is a functional block diagram of the music editing apparatus having the network communicating section.

FIG. 27 shows a structure of another music editing apparatus 80 according to an embodiment of the present invention. FIG. 28 is a functional block diagram of the music editing apparatus 80. The music editing apparatus 80 has a network communicating section 81 that can be connected to the Internet 82.

Since the music editing apparatus 80 has the network communicating section 81, the user can exchange and/or share a remix pattern file through a network such as the Internet 82 and a third party can download a remix created by another user and enjoys it. Instead, a remix pattern provided by a content service side rather than a private user may be used.

With the music editing apparatus 80, a new music-based communication through which connecting methods for songs are published on the Internet or the like, they are shared by other persons, and remixes are created and evaluated by a plurality of persons can be accomplished.

Figure 29:
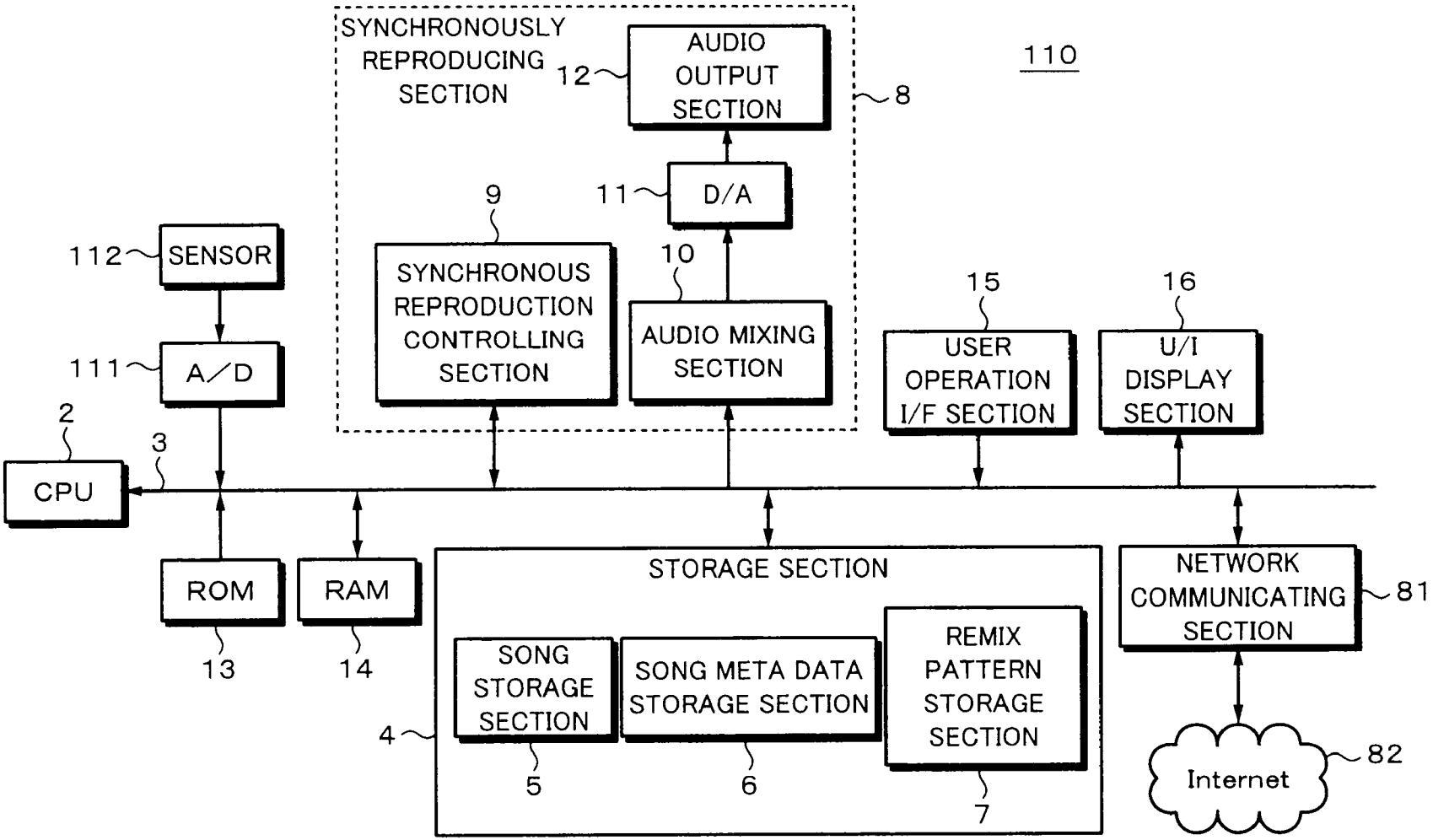
FIG. 29 is a schematic diagram showing a structure of the music editing apparatus having a sensor value obtaining section.
Figure 30:
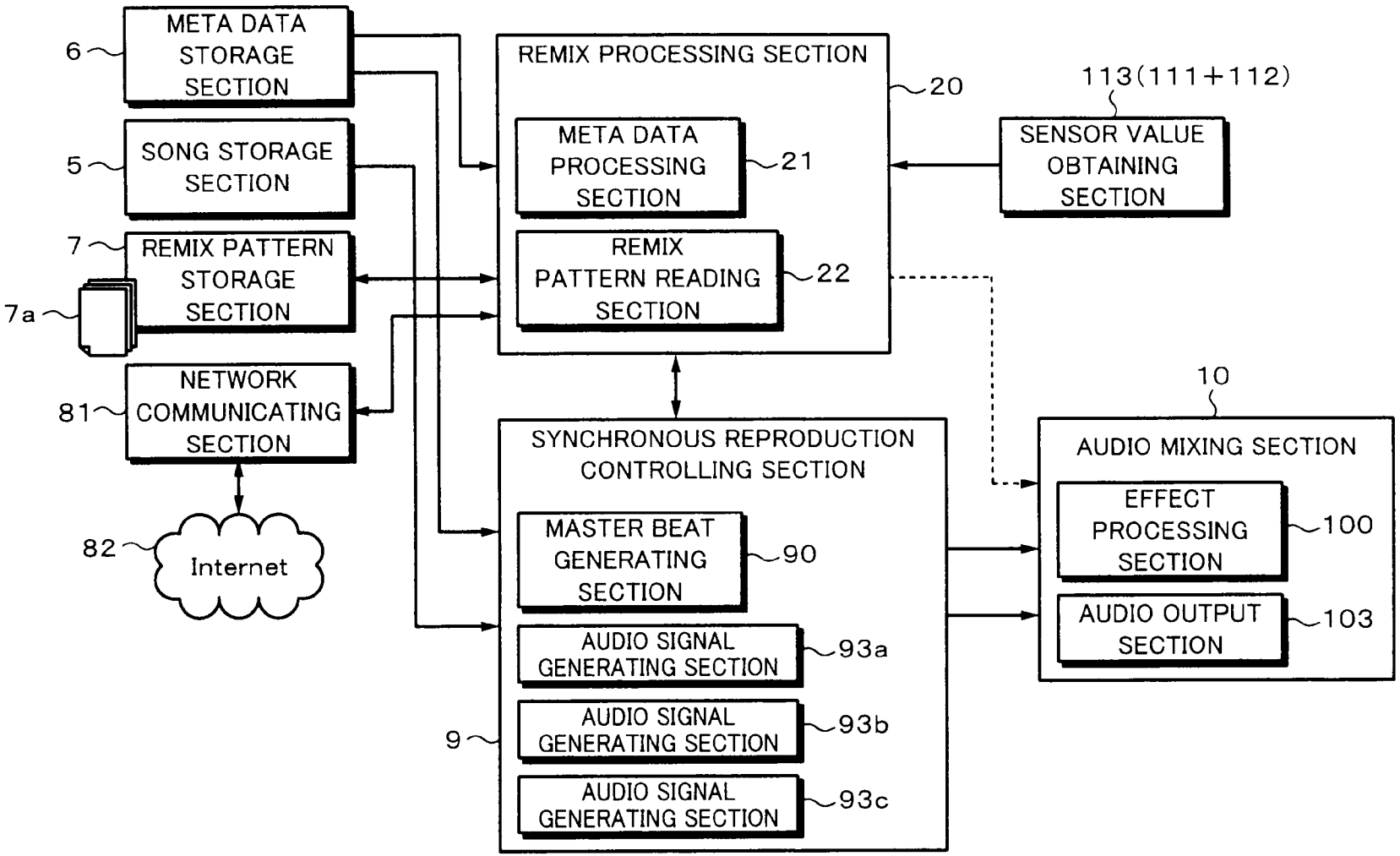
FIG. 30 is a functional block diagram showing the music editing apparatus having the sensor value obtaining section.

FIG. 29 and FIG. 30 show a hardware structure and a functional block diagram of another music editing apparatus 110, respectively. The music editing apparatus 110 has a structure of which a sensor value is obtained from a sensor 112 through an A/D converter 111. The music editing apparatus 110 functionally has a sensor value obtaining section.

As in an invention disclosed, for example, as "Reproduction State Controlling Apparatus And Reproduction Sate Controlling Method" (Japanese Patent Application Laid-Open No. 2005-156641), a sensor value obtaining section 113 is based on a technique of detecting a walking tempo using an acceleration sensor and changing the tempo of a song corresponding to the walking tempo. When this example is applied, the tempo of the master beat generating section can be changed corresponding to the walking tempo and all songs can be reproduced as remixes corresponding to the walking tempo and jogging tempo. In addition, as in "Reproducing Apparatus And Reproducing Method For Audio Signal" (Japanese Patent Application No. 2005-363094), an invention of selecting songs corresponding to the walking tempo or jogging tempo may be applied.

To apply these techniques, a sensor is essential. When the sensor and the algorithms of these inventions are applied to the system of the present invention, songs can be selected corresponding to the state of the user, the selected songs can be remixed, and they can be seamlessly reproduced.

Figure 31A:
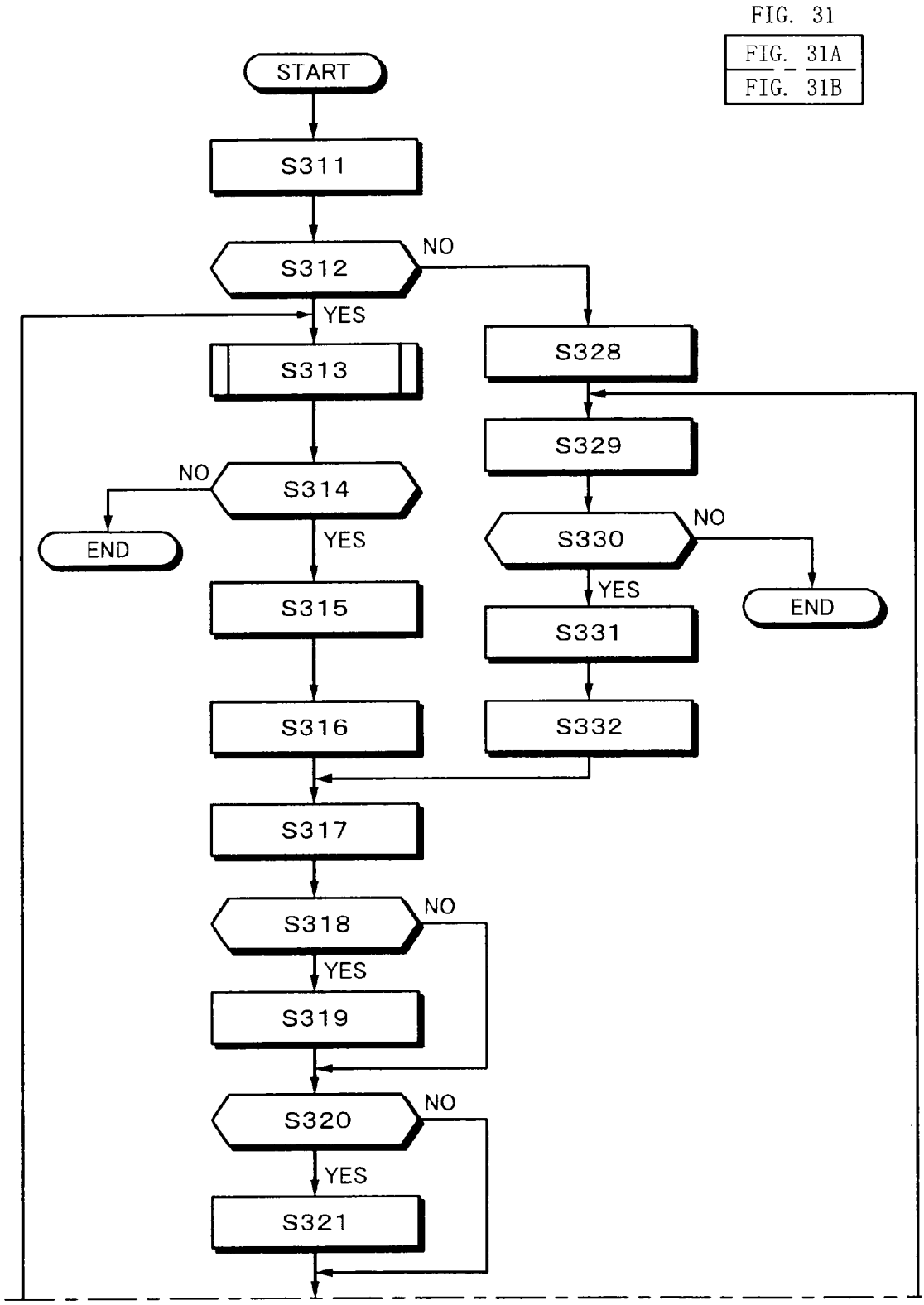
FIG. 31A and FIG. 31B are flow charts showing processes of the music editing apparatus having the sensor value obtaining section.
Figure 31B:
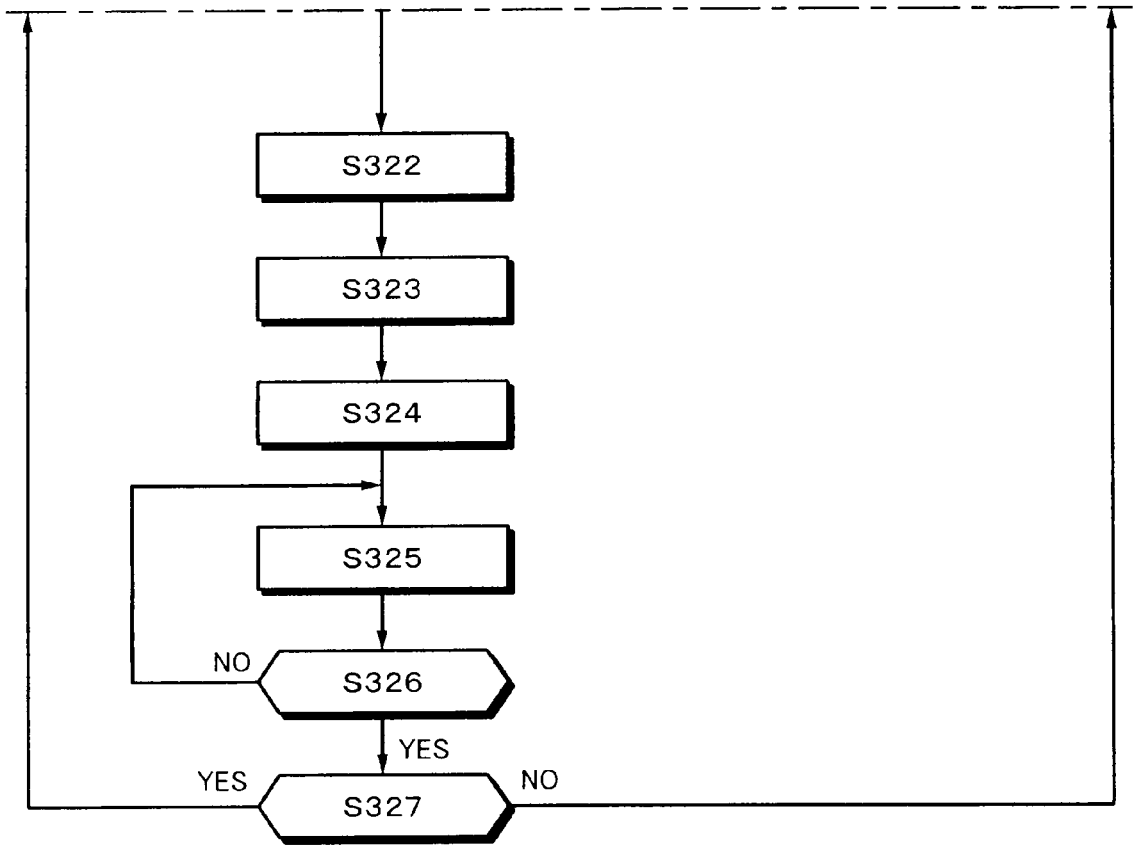

FIG. 31A and FIG. 31B are flow charts showing processes of the music editing apparatus 110 having a sensor priority mode. The processes have a sensor priority mode in addition to a remix pattern priority mode. Processes change, for example, depending on the mode that the user selects. In the sensor priority mode, the sensor detects, for example, a walking pattern or a jogging pattern and the music editing apparatus 110 changes beats corresponding to the detected pattern.

First, it is determined whether the mode of the music editing apparatus 110 is the sensor priority mode or the pattern priority mode (at step S11). In this case, the sensor priority mode is based on the technique of selecting songs depending on whether the user is walking or jogging. The sensor decides the order of songs and selects songs. Thus songs may not be decided corresponding to a pattern. It may suggest that they are dynamically changed. In other words, as a concept, the music editing apparatus 110 dynamically creates a pattern file with a value supplied from the sensor, not read a prefixed pattern file.

When the pattern priority mode rather than the sensor priority mode has been selected at step S311, the same processes shown in FIG. 4 are performed.

Next, the case of which the sensor priority mode has been selected at step S311 or step S312 will be described. In this case, songs are automatically selected corresponding to jogging and the selected songs are automatically connected corresponding thereto.

As a subroutine, songs and their tempos are decided corresponding to the input from the sensor (at step S313). When the determined result at step S314 denotes that there is another song, the flow advances to step S315. At step S315, the tempo of a master beat is set. In this case, the tempo of the master beat has been detected and set corresponding to the walking tempo. In this case, since the song connecting method has not been always decided, it is automatically decided (at step S316). For example, in the jogging mode, all the songs may be simply connected with cross-fade. Instead, when meta data of the next song denotes that it is fad in, the current song may be simply overlaid. Since the processes after step S317 are the same as those from step S6 to step S15 of FIG. 4, their description will be omitted.

Thus, with the music editing apparatus 110, songs are selected corresponding to the jogging tempo and the selected songs are seamlessly connected. Thus, since the songs do not disorder the tension and tempo of jogging, the user can comfortably enjoy jogging. With a particular type of a sensor, a remix corresponding to another rhythmical motion (for example, dancing) or the heart rate of the user instead of jogging can be created.

Songs are selected corresponding to the input from the sensor, the tempos of the selected songs are matched with the tempo of the jogging, and the songs are remixed with the matched tempo. Thus the user can enjoy his or her favorite songs corresponding to his or her tempo.

In addition, timer remix reproduction can be performed. It is assumed that the user wants to listen to songs of his or her favorite album or those of a play list in 30 minutes for his or her commuting. Conventionally, if the duration of the album is 60 minutes, he or she has to stop reproducing songs in 30 minutes. In contrast, with the system according to the present invention, a remix can be created by selecting tempos and parts of songs so that the reproduction duration of songs becomes 30 minutes. The timer remix reproduction can be applied to jogging. When the user wants to jog only for 30 minutes, a remix of songs for 30 minutes corresponding to the tempo of jogging can be created.

A remix of only catchy parts of songs for 30 minutes of commuting can be created so that the remix is complete when the user arrives at the destination. In addition, as the current time approaches the arrival time, an atmosphere that allows the user to feel that he or she is approaching the destination can be created in such a manner that the tempo of songs is gradually decreased or particular SE is overlaid.

As described above, with the music editing apparatus 80 and 110, a new music-based communication through which a connecting method for songs is published, for example, on the Internet, shared by other persons, remixes are created by a plurality of persons, and they are evaluated by them can be achieved. In addition, with a sensor, the user can listen to music that well fits his or her situation and state.

These features will make a new wave against the conventional world in which the user enjoys work that professional creators and musicians created and allow the user to experience a new world in which he or she reuses and recomposes their work as materials with which he or she expresses himself or herself and enjoy the result.

When users who find an amusement in such a new type music increase, the entire music industry will become active. In addition, from a view point of the music industry side, there is a possibility of which there will be music work that allows the user side to recompose and new creators to create such work. Thus there is a possibility of which the industry and users can establish new music cultures.

Last, characteristics that can be used in the music editing apparatus of the present invention will be described. The music editing apparatus is characterized in that it has means for tracking beats of a rhythm of music in real time. In addition, the music editing apparatus is characterized in that it has means of correctly and accurately tracking beats of a rhythm of music in real time with time line meta data (time information such as time stamp information that represents such as beat positions) that have been provided. In addition, the music editing apparatus is characterized in that it has means for generating a beat synchronous signal in synchronization with a song to be reproduced from time line meta data (time information such as time stamp information that represents such as beat positions).

In addition, the music editing apparatus is characterized in that it has means for tracking beats of a rhythm of music from time line meta data in real time although the tempo and rhythm of a song of the music change. In addition, the music editing apparatus is characterized in that it has a plurality of reproduction tracks for successively or simultaneously reproducing a plurality of songs having different tempos and rhythms.

In addition, the music editing apparatus is characterized in that it has a plurality of reproduction tracks for reproducing successively or simultaneously reproducing a plurality of songs having different tempos and rhythms and means for synchronously reproducing songs that overlap in a transition period for which one song is switched to another song. In addition, the music editing apparatus is characterized in that it has a plurality of tracks for successively or simultaneously reproducing a plurality of tracks having different tempos and rhythms and means for selecting songs to be synchronously reproduced such that the songs overlap in a transition state of which one song is switched to another song.

In addition, the music editing apparatus is characterized in that it has means for successively or simultaneously reproducing a plurality of songs having different tempos and rhythms in synchronization with a reference beat without changes of their tempos and rhythms. In addition, the music editing apparatus is characterized in that it has PLL circuits corresponding to tracks as means for successively or simultaneously reproducing a plurality of songs having different tempos and rhythms in synchronization with a reference beat without changes of their tempos and rhythms.

In addition, the music editing apparatus is characterized in that a reference beat is input to each track as means for successively or simultaneously reproducing a plurality of songs having different tempos and rhythms in synchronization with the reference beat without changes of their tempos and rhythms. In addition, the music editing apparatus is characterized in that it has means for generating a beat synchronous signal for each track from time line meta data as means for successively or simultaneously reproducing a plurality of songs having different tempos and rhythms in synchronization with a reference beat without changes of their tempos and rhythms.

In addition, the music editing apparatus is characterized in that it has means for deciding a tempo of a reference beat as a master for synchronous reproduction. In addition, the music editing apparatus is characterized in that it has means for tracking beats of a rhythm of music in real time and generating a current beat count value. In addition, the music editing apparatus is characterized in that it has means for tracking beats of a rhythm of music in real time and generating a current bar count value.

The invention claimed is:

1. A music editing apparatus, comprising:

a remix processing section which performs a remix process based on both meta data pre-generated corresponding to song data and containing at least time-based beat positions and a remix pattern file including data indicating an order and a manner for mixing together a plurality of songs;

a synchronous reproduction controlling section which generates a master beat, sends the master beat to the remix processing section, and reproduces the plurality of songs with individual entries of the meta data corresponding to a remix process which the remix processing section designates based on the remix pattern file and the meta data; and a mixing section which mixes the songs reproduced by the synchronous reproduction controlling section, the synchronous reproduction controlling section comprising:

a phase comparator which compares a phase of a beat synchronous signal generated from the meta data with that of the master beat signal;

an integrating circuit which integrates a phase compared output of the phase comparator; and a correcting section which corrects a tempo based on an integrated output of the integrating circuit.

2. The music editing apparatus as set forth in claim 1, wherein that the remix processing section comprises:

a meta data processing section which processes the meta data; and a remix pattern reading section which reads the remix pattern file.

3. The music editing apparatus as set forth in claim 1, wherein the synchronous reproduction controlling section has a plurality of audio signal generating sections which generate audio signals of the plurality of audio signals, each of the plurality of audio signal generating sections including a phase comparator which compares a phase of a beat synchronous signal generated from the meta data with that of the master beat signal; an integrating circuit which integrates a phase compared output of the phase comparator; and a correcting section which corrects a tempo based on an integrated output of the integrating circuit.

4. The music editing apparatus as set forth in claim 1, wherein a tempo correction amount used in the correcting section causes a phase error of a system to become minimal and forms a negative feedback of the system.

5. The music editing apparatus as set forth in claim 1, wherein the synchronous reproduction controlling section uses wholes or parts of the plurality of songs.

6. The music editing apparatus as set forth in claim 3, wherein each of the plurality of audio signal generating sections of the synchronous reproduction controlling section includes a decoder and a time stretch section.

7. The music editing apparatus as set forth in claim 1, further comprising a network communicating section, that obtains the meta data from a server on a network.

8. The music editing apparatus as set forth in claim 1, further comprising a network communicating section, that allows the remix pattern file to be shared on a network.

9. The music editing apparatus as set forth in claim 1, further comprising a sensor value obtaining section which measures and obtains a user's walking or jogging tempo, where the synchronous reproduction controlling section generates a tempo of a master beat based on the measured tempo.

10. A music editing method, comprising:

performing a remix process based on both meta data pre-generated corresponding to song data and containing at least time-based beat positions and a remix pattern file including data indicating an order and a manner for mixing together a plurality of songs;

generating a master beat, sending the master beat to the remix processing section, and reproducing the plurality of songs corresponding to a remix process which the remix processing section designates based on the remix pattern file and the meta data; and mixing the songs reproduced by the synchronous reproduction controlling section, wherein reproducing the plurality of songs corresponding to the remix process further comprises:

comparing a phase of a beat synchronous signal generated from the meta data supplied from the remix processing step with a phase of the master beat signal to generate a phase compared output;

integrating the phase compared output to generate an integrated output; and correcting a tempo based on the integrated output.

11. A music editing apparatus, comprising:

a remix processing means for performing a remix process based on both meta data pre-generated corresponding to song data and containing at least time-based beat positions and a remix pattern file including data indicating an order and a manner for mixing together a plurality of songs;

a synchronous reproduction controlling means for generating a master beat, sends the master beat to the remix processing means, and reproduces the plurality of songs with individual entries of the meta data corresponding to a remix process which the remix processing means designates based on the remix pattern file and the meta data; and a mixing means for mixing together the plurality of songs reproduced by the synchronous reproduction controlling means, the synchronous reproduction controlling means comprising:

a phase comparator which compares a phase of a beat synchronous signal generated from the meta data with that of the master beat signal;

an integrating circuit which integrates a phase compared output of the phase comparator; and a correcting section which corrects a tempo based on an integrated output of the integrating circuit.

* * * * *